US006730264B2

(12) United States Patent
Cao

(10) Patent No.: US 6,730,264 B2
(45) Date of Patent: May 4, 2004

(54) NICKEL-BASE ALLOY

(75) Inventor: Wei-Di Cao, Charlotte, NC (US)

(73) Assignee: ATI Properties, Inc., Albany, OR (US)

( * ) Notice: Subject to any disclaimer, the term of this patent is extended or adjusted under 35 U.S.C. 154(b) by 54 days.

(21) Appl. No.: 10/144,369

(22) Filed: May 13, 2002

(65) Prior Publication Data

US 2003/0213536 A1 Nov. 20, 2003

(51) Int. Cl.[7] ..... C22C 19/05

(52) U.S. Cl. ..... 420/448; 148/428; 420/449; 420/450

(58) Field of Search ..... 148/428; 420/447, 420/448, 449, 450

(56) References Cited

U.S. PATENT DOCUMENTS

| | | | | |
|---|---|---|---|---|
| 3,046,108 A | | 7/1962 | Eiselstein | |
| 4,219,592 A | * | 8/1980 | Anderson et al. | 427/405 |
| 4,371,404 A | | 2/1983 | Duhl et al. | |
| 4,652,315 A | | 3/1987 | Igarashi et al. | |
| 4,750,944 A | * | 6/1988 | Snyder et al. | 148/522 |
| 4,777,017 A | | 10/1988 | Khan et al. | |
| 4,814,023 A | | 3/1989 | Chang | |
| 4,837,384 A | | 6/1989 | Khan et al. | |
| 4,888,253 A | | 12/1989 | Snyder et al. | |
| 4,981,644 A | | 1/1991 | Chang | |
| 5,006,163 A | | 4/1991 | Benn et al. | |
| 5,047,091 A | | 9/1991 | Khan et al. | |
| 5,077,004 A | | 12/1991 | Schweizer et al. | |
| 5,104,614 A | | 4/1992 | Ducrocq et al. | |
| 5,131,961 A | | 7/1992 | Sato et al. | |
| 5,154,884 A | | 10/1992 | Wukusick et al. | |
| 5,156,808 A | | 10/1992 | Henry | |
| 5,403,546 A | | 4/1995 | Khan et al. | |
| 5,431,750 A | * | 7/1995 | Kawai et al. | 148/410 |
| 5,435,861 A | | 7/1995 | Khan et al. | |
| 5,916,382 A | | 6/1999 | Sato et al. | |
| 6,106,767 A | | 8/2000 | Kennedy et al. | |

OTHER PUBLICATIONS

X. Xie et al., "The Role Of Mg On Structure And Mechanical Properties In Alloy 718," Superalloys 1988, pp. 635–642 (1988).

Cao et al., "The Effect of Phosphorous On Mechanical Properties Of Alloy 718," Superalloys 718, 625, 706 and Various Derivatives, pp. 463–477 (1994).

(List continued on next page.)

*Primary Examiner*—John P. Sheehan
(74) *Attorney, Agent, or Firm*—Patrick J. Viccaro

(57) ABSTRACT

A nickel-base alloy includes, in weight percent, up to about 0.10 percent carbon; about 12 up to about 20 percent chromium; up to about 4 percent molybdenum; up to about 6 percent tungsten, wherein the sum of molybdenum and tungsten is at least about 2 percent and not more than about 8 percent; about 5 up to about 12 percent cobalt; up to about 14 percent iron; about 4 percent up to about 8 percent niobium; about 0.6 percent up to about 2.6 percent aluminum; about 0.4 percent up to about 1.4 percent titanium; about 0.003 percent up to about 0.03 percent phosphorous; about 0.003 percent up to about 0.015 percent boron; nickel; and incidental impurities. The sum of atomic percent aluminum and atomic percent titanium is from about 2 to about 6 percent, the ratio of atomic percent aluminum to atomic percent titanium is at least about 1.5, and the atomic percent of aluminum plus titanium divided by the atomic percent of niobium equals about 0.8 to about 1.3. The nickel-base alloy may be provided in the form of an article of manufacture, such as, for example, a disk, a blade, a fastener, a case, or a shaft. A method for making a nickel-base alloy also is disclosed. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims.

38 Claims, 12 Drawing Sheets

OTHER PUBLICATIONS

Kennedy et al., "Stress Rupture Strength of Alloy 718," Advanced Materials & Processes, pp. 33–35 (1996).
Cao et al., "Phosphorous—Boron Interaction In Nickel–Base Superalloys," Superalloys 1996, pp. 589–597 (1996).
Cao et al., "Effect and Mechanism of Phosphorous and Boron on Creep Deformation of Alloy 718," Superalloys 718, 625, 706 and Various Derivatives, pp. 511–520 (1997).
Cao et al., "Production Evaluation of 718–ER® Alloy," Superalloys 2000, pp. 101–108 (2000).
Xie et al., "The Role of Phosphorous and Sulfur in Inconel 718," Superalloys 1996, pp. 599–606 (1996).
Xie et al., "Segregation Behavior of Phosphorous and Its Effect on Microstructure and Mechanical Properties in Alloy System Ni–Cr–Fe–Mo–Nb–Ti–Al," Superalloys 718, 625, 706 and Various Derivatives, pp. 531–542 (1997).
Collier et al., "The Effect of Varying Al, Ti, and Nb Content On The Phase Stability of INCONEL 718," Metallurgical Transactions A, vol. 19A, pp. 1657–1666 (1988).
Collier et al., "On Developing A Microstructurally and Thermally Stable Iron–Nickel Superalloy," Superalloys 1988, pp. 43–52 (1988).
Manriquez et al., "The High Temperature Stability Of IN718 Derivative Alloys," Superalloys 1992, pp. 507–516 (1992).
Cozar et al., "Morphology of Y'and YΔ Precipitates and Thermal Stability of Inconel 718 Type Alloys," Metallurgical Transactions, vol. 4, pp. 47–59 (1973).
Andrieu et al., "Effect of Environment and Microstructure on the High Temperature Behavior of Alloy 718," Superalloy 718—Metallurgy and Applications, pp. 241–256 (1989).

Andrieu et al., "Influence of Compositional Modifications on Thermal Stability of Alloy 718," Superalloys 718, 625, 706 and Various Derivatives, pp. 695–710 (1994).

Guo et al., "Improving Thermal Stability of Alloy 718 Via Small Modifications in Composition," Superalloy 718–13 Metallurgy and Applications, pp. 567–576 (1989).

Guo et al., "Further Studies on Thermal Stability of Modified 718 Alloys," Superalloys 718–625, 706 and Various Derivatives, pp. 721–734 (1994).

Chang et al., "Rene 220: 100° F Improvement Over Alloy 718," Superalloy 718——Metallurgy and Applications, pp. 631–645 (1989).

Schafrik et al., "Application of Alloy 718 in GE Aircraft Engines: Past, Present and Next Five Years," Superalloys 718, 625, 706 and Various Derivatives, pp. 1–11 (2001).

Cao et al., U.S. patent app. Ser. No. 10/679,899, entitled "Nickel–Base Alloys and Methods of Heat Treating Nickel–Base Alloys" Filed Oct. 6, 2003, and assigned to ATI Properties, Inc.

* cited by examiner (a) (b)

NICKEL-BASE ALLOY

FIELD OF THE INVENTION

The present invention relates generally to nickel-base alloys. In particular, the present invention relates to nickel-base alloys that can be affordable and can exhibit superior temperature capability and comparable processing characteristics relative to certain nickel-based superalloys, such as the well-known Alloy 718, versions of which are available from Allegheny Ludlum Corporation, Pittsburgh, Pa., and Allvac, Monroe, N.C. under the names Altemp® 718 and Allvac® 718 alloys, respectively. The present invention is also directed to a method of making a nickel-base alloy and an article of manufacture that includes a nickel-base alloy. The nickel-base alloy of the present invention finds application as, for example, components for gas turbine engines, such as disks, blades, fasteners, cases, or shafts

DESCRIPTION OF THE INVENTION BACKGROUND

The improved performance of the gas turbine engine over the years has been paced by improvements in the elevated temperature mechanical properties of nickel-base superalloys. These alloys are the materials of choice for most of the components of gas turbine engines exposed to the hottest operating temperatures. Components of gas turbine engines such as, for example, disks, blades, fasteners, cases, and shafts all are fabricated from nickel-base superalloys and are required to sustain high stresses at very high temperatures for extended periods of time. The need for improved nickel-base superalloys has resulted in many issued patents in this area, including, for example, U.S. Pat. Nos. 3,046,108; 4,371,404; 4,652,315; 4,777,017; 4,814,023; 4,837,384; 4,981,644; 5,006,163; 5,047,091; 5,077,004; 5,104,614; 5,131,961; 5,154,884; 5,156,808; 5,403,546; 5,435,861 and 6,106,767.

In many cases, improved performance is accomplished by redesigning parts so as to be fabricated from new or different alloys having improved properties (e.g., tensile strength, creep rupture life, and low cycle fatigue life) at higher temperatures. The introduction of a new alloy, however, particularly when introduced into a critical rotating component of a gas turbine engine, can be a long and costly process and may require a compromise of certain competing characteristics.

Alloy 718 is one of the most widely used nickel-base superalloys, and is described generally in U.S. Pat. No. 3,046,108. Alloy 718 has a typical composition as illustrated in the table below.

Typical Chemical Composition of Alloy 718

| Element | Weight Percent |
|---|---|
| Carbon | 0.08 maximum |
| Manganese | 0.35 maximum |
| Phosphorous | 0.015 maximum |
| Sulfur | 0.015 maximum |
| Silicon | 0.35 maximum |
| Chromium | 17–21 |
| Nickel | 50–55 |
| Molybdenum | 2.8–3.3 |
| Niobium plus Tantalum | 4.75–5.5 |
| Titanium | 0.65–1.15 |

-continued

Typical Chemical Composition of Alloy 718

| Element | Weight Percent |
|---|---|
| Aluminum | 0.2–0.8 |
| Cobalt | 1 maximum |
| Boron | 0.006 maximum |
| Copper | 0.3 maximum |
| Iron | Balance |

The extensive use of Alloy 718 stems from several unique features of the alloy. Alloy 718 has high strength, along with balanced creep and stress rupture properties up to about 1200° F. (649° C.). While most high strength nickel-base superalloys derive their strength by the precipitation of γ' phase, with aluminum and titanium being major strengthening elements, i.e., $Ni_3(Al, Ti)$, Alloy 718 is strengthened mainly by γ" phase with niobium, i.e. $Ni_3Nb$, being a major strengthening element and with a small amount of γ' phase playing a secondary strengthening role. Since the γ" phase has a higher strengthening effect than γ' phase at the same volume fraction and particle size, Alloy 718 is generally stronger than most superalloys strengthened by γ' phase precipitation. In addition, γ" phase precipitation results in good high temperature time-dependent mechanical properties such as creep and stress rupture properties. The processing characteristics of Alloy 718, such as castability, hot workability and weldability, are also good, thereby making fabrication of articles from Alloy 718 relatively easy. These processing characteristics are believed to be closely related to the lower precipitation temperature and the sluggish precipitation kinetics of the γ" phase associated with Alloy 718.

At temperatures higher than 1200° F. (649° C.), however, the γ" phase has very low thermal stability and will rather rapidly transform to a more stable δ phase that has no strengthening effect. As a result of this transformation, the mechanical properties, such as stress rupture life, of Alloy 718 deteriorate rapidly at temperatures above 1200° F. (649° C.). Therefore, the use of Alloy 718 typically is limited to applications below 1200° F. (649° C.).

Due to the foregoing limitations of Alloy 718, many attempts have been made to improve upon that superalloy. U.S. Pat. No. 4,981,644 describes an alloy known as the Rene' 220 alloy. Rene' 220 alloy has temperature capabilities of up to 1300° F. (704° C.), or 100° F. (56° C.) greater than Alloy 718. Rene' 220 alloy, however, is very expensive, at least partly because it contains at least 2 percent (typically 3 percent) tantalum, which can be from 10 to 50 times the cost of cobalt and niobium. In addition, Rene' 220 alloy suffers from relatively heavy δ phase content, and only about 5% rupture ductility, which may lead to notch brittleness and low dwell fatigue crack growth resistance.

Another nickel-base superalloy, known as Waspaloy® (a registered trademark of Pratt & Whitney Aircraft) nickel-base superalloy (UNS N07001), available from Allvac, Monroe, N.C., is also widely used for aerospace and gas turbine engine components at temperatures up to about 1500° F. (816° C.). This nickel-base superalloy has a typical composition as illustrated in the table below.

Typical Chemical Composition of Waspaloy Nickel-Base Alloy

| Element | Weight Percent |
|---|---|
| Carbon | 0.02–0.10 |
| Manganese | 0.1 maximum |
| Phosphorous | 0.015 maximum |
| Sulfur | 0.015 maximum |
| Silicon | 0.15 maximum |
| Chromium | 18–21 |
| Iron | 2 maximum |
| Molybdenum | 3.5–5.0 |
| Titanium | 2.75–3.25 |
| Aluminum | 1.2–1.6 |
| Cobalt | 12–15 |
| Boron | 0.003–0.01 |
| Copper | 0.1 maximum |
| Zirconium | 0.02–0.08 |
| Nickel | Balance |

While Waspaloy nickel-base superalloy possesses superior temperature capability compared to Alloy 718, it is more expensive than Alloy 718, resulting, at least partly, from increased amounts of the alloying elements nickel, cobalt, and molybdenum. Also, processing characteristics, such as hot workability and weld ability, are inferior to those of Alloy 718, due to strengthening by γ', leading to higher manufacturing cost and more limited component repairability.

Thus, it is desireable to provide an affordable, weldable, hot workable nickel-base alloy that has high temperature capability greater than that of Alloy 718.

SUMMARY OF THE INVENTION

According to one particular embodiment of the present invention, the nickel-base alloy comprises, in weight percent: up to about 0.10 percent carbon; about 12 up to about 20 percent chromium; 0 up to about 4 percent molybdenum; 0 up to about 6 percent tungsten, wherein the sum of molybdenum and tungsten is at least about 2 percent and not more than about 8 percent; about 5 up to about 12 percent cobalt; 0 up to about 14 percent iron; about 4 percent up to about 8 percent niobium; about 0.6 percent up to about 2.6 percent aluminum; about 0.4 percent up to about 1.4 percent titanium; about 0.003 percent up to about 0.03 percent phosphorous; about 0.003 percent up to about 0.015 percent boron; nickel, and incidental impurities. According to the present invention, the atomic percent of aluminum plus titanium is from about 2 to about 6 percent, the atomic percent ratio of aluminum to titanium is at least about 1.5; and/or the sum of atomic percent of aluminum plus titanium divided by the atomic percent of niobium equals from about 0.8 to about 1.3. The present invention relates to nickel-base alloys characterized by including advantageous levels of aluminum, titanium and niobium, advantageous levels of boron and phosphorous, and advantageous levels of iron, cobalt and tungsten.

The present invention also relates to articles of manufacture such as, for example, a disk, a blade, a fastener, a case, or a shaft fabricated from or including the nickel-base alloy of the present invention. The articles formed of the nickel-base alloy of the present invention may be particularly advantageous when intended for service as component(s) for a gas turbine engine.

Furthermore, the present invention relates to a nickel-base alloy comprising, in weight percent: 0 up to about 0.08 percent carbon, 0 up to about 0.35 percent manganese; about 0.003 up to about 0.03 percent phosphorous; 0 up to about 0.015 percent sulfur; 0 up to about 0.35 percent silicon; about 17 up to about 21 percent chromium; about 50 to about 55 percent nickel; about 2.8 up to about 3.3 percent molybdenum; about 4.7 percent up to about 5.5 percent niobium; 0 up to about 1 percent cobalt; about 0.003 up to about 0.015 percent boron; 0 up to about 0.3 percent copper; and balance being iron (typically about 12 to about 20 percent), aluminum, titanium and incidental impurities, wherein the sum of atomic percent aluminum and atomic percent titanium is from about 2 to about 6 percent, the ratio of atomic percent aluminum to atomic percent titanium is at least about 1.5, and the sum of atomic percent of aluminum plus titanium divided by the atomic percent of niobium equals from about 0.8 to about 1.3.

The present invention also relates to a method for making a nickel-base alloy. In particular, according to such method of the present invention, a nickel-base alloy having a composition within the present invention as described above is provided and is subject to processing, including solution annealing, cooling and aging. The alloy may be further processed to an article of manufacture or into any other desired form.

DETAILED DESCRIPTION OF EMBODIMENTS OF THE INVENTION

Figure 1:
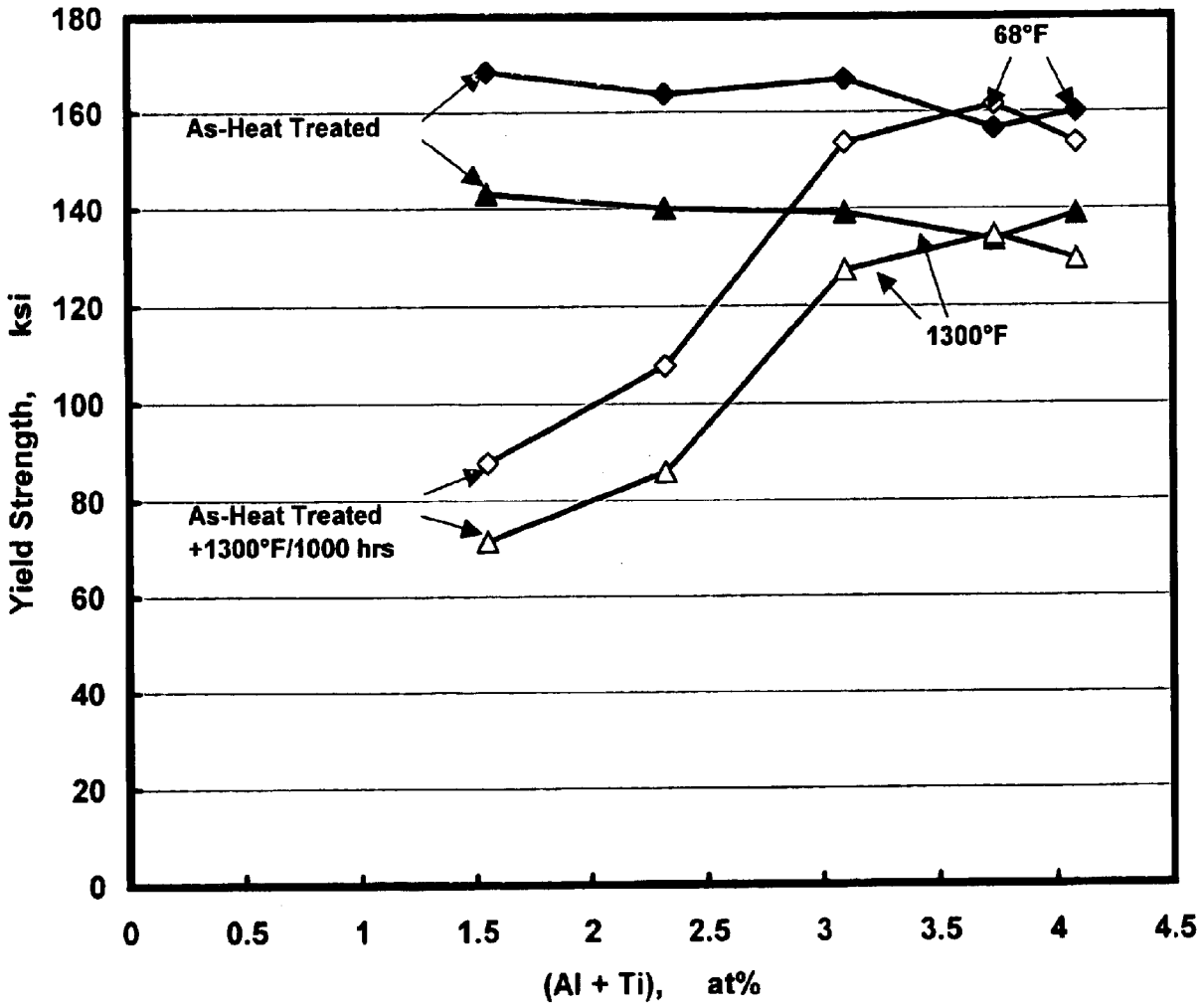
FIG. 1 is a plot of yield strength versus aluminum plus titanium atomic percentage for certain nickel-base alloys with a ratio of aluminum atomic percent to titanium atomic percent of 3.6–4.1.

The present invention relates to nickel-base alloys that include advantageous amounts of aluminum, titanium and niobium, advantageous amounts of boron and phosphorous, and advantageous amounts of iron, cobalt, and tungsten. According to one particular embodiment of the present invention, the nickel-base alloy comprises, in weight percent: up to about 0.10 percent carbon; about 12 up to about 20 percent chromium; 0 up to about 4 percent molybdenum; 0 up to about 6 percent tungsten, wherein the sum of molybdenum and tungsten is at least about 2 percent and not more than about 8 percent; about 5 up to about 12 percent cobalt; 0 up to about 14 percent iron; about 4 percent up to about 8 percent niobium; about 0.6 percent up to about 2.6 percent aluminum; about 0.4 percent up to about 1.4 percent titanium; about 0.003 percent up to about 0.03 percent phosphorous; about 0.003 percent up to about 0.015 percent boron; nickel, and incidental impurities. According to the present invention, the atomic percent of aluminum plus titanium is from about 2 to about 6 percent, the atomic percent ratio of aluminum to titanium is at least about 1.5; and/or the sum of atomic percent of aluminum plus titanium divided by the atomic percent of niobium equals from about 0.8 to about 1.3.

One feature of embodiments of the nickel-base alloy of the present invention is that the content of aluminum, titanium and/or niobium and their relative ratio may be adjusted in a manner that provides advantageous thermal stability of microstructure and mechanical properties, especially rupture and creep strength, at high temperature. The aluminum and titanium contents of the alloy of the present invention, in conjunction with the niobium content, apparently result in the alloy being strengthened by $\gamma'+\gamma''$ phase with niobium-containing $\gamma'$ as the dominant strengthening phase. Unlike the typical relatively high titanium, relatively low aluminum combination that is adopted in certain other nickel-base superalloys, the relatively high aluminum atomic percent to titanium atomic percent ratio of the alloy of the present invention is believed to increase thermal stability of the alloy, which appears to be important for maintaining good mechanical properties, such as stress rupture properties, after long periods of exposure to high temperatures.

Another feature of embodiments of the present invention is the manner in which boron and phosphorous are utilized. When phosphorous and boron are added in amounts within the nickel-base alloy of the present invention, the creep and stress rupture resistance of alloys may be improved, without significant detrimental effect on tensile strength and ductility. The present inventor has observed that modification of phosphorous and boron contents appears to be a relatively cost-effective way to improve mechanical properties of the nickel-base superalloy.

Yet another feature of embodiments of the present invention is the utilization of amounts of iron and cobalt that appear to provide high strength, high creep/stress rupture resistance, high thermal stability and good processing characteristics with a relatively minimal increase in raw material costs. First, it appears that cobalt can change the kinetics of precipitation and growth of both $\gamma''$ and $\gamma'$ phases by making these precipitates finer and more resistant to growth at relatively high temperatures. Cobalt is also believed to reduce the stacking fault energy, thereby making dislocation movement more difficult and improving stress rupture life. Second, it is believed that by controlling the iron content in an optimum range, the stress rupture properties of the alloy may be improved without significantly reducing alloy strength.

Another feature of embodiments of the present invention is addition of molybdenum and tungsten at levels that improve the mechanical properties of the alloys. When molybdenum and tungsten are added in amounts within the present invention, at least about 2 weight percent and not more than about 8 weight percent, it is believed that tensile strength, creep/stress rupture properties and thermal stability of the alloy are improved.

According to one embodiment of the present invention, the amounts of aluminum and titanium in Alloy 718 were adjusted to improve the temperature capabilities of that superalloy. The inventor prepared a number of alloys to study the effect of aluminum and titanium balance on mechanical properties and thermal stability of Alloy 718. The compositions of the alloys are listed in Table 1. As is apparent, Heats 2 and 5 both contain aluminum and titanium in amounts within the typical composition of Alloy 718, whereas in the remaining heats the content of at least one of aluminum and titanium is outside of the typical composition of Alloy 718.

TABLE 1

CHEMICAL COMPOSITION OF TEST ALLOYS TO STUDY ALUMINUM AND TITANIUM EFFECTS

| | Al/Ti | Al + Ti | Chemical Composition (wt %) | | | | | | | | | | |
|---|---|---|---|---|---|---|---|---|---|---|---|---|---|
| Heat | (at %) | (at %) | C | Mo | W | Cr | Co | Fe | Nb | Ti | Al | P | B |
| 1 | 3.97 | 1.5 | 0.025 | 2.88 | <0.01 | 17.9 | 0.01 | 18.0 | 5.42 | 0.29 | 0.54 | 0.0060 | 0.0040 |
| 2 | 0.96 | 1.5 | 0.028 | 2.89 | <0.01 | 17.9 | <0.01 | 18.1 | 5.39 | 0.65 | 0.35 | 0.0064 | 0.0047 |
| 3 | 0.23 | 1.5 | 0.027 | 2.88 | <0.01 | 17.9 | <0.01 | 18.1 | 5.42 | 1.00 | 0.14 | 0.0070 | 0.0035 |
| 4 | 3.64 | 2.25 | 0.026 | 2.88 | <0.01 | 18.1 | <0.01 | 17.8 | 5.37 | 0.41 | 0.84 | 0.0050 | 0.0046 |
| 5 | 0.93 | 2.25 | 0.031 | 2.9 | <0.01 | 17.8 | <0.01 | 18.1 | 5.47 | 0.99 | 0.52 | 0.0070 | 0.0060 |
| 6 | 0.24 | 2.25 | 0.026 | 2.89 | <0.01 | 17.9 | <0.01 | 18.0 | 5.42 | 1.49 | 0.20 | 0.0070 | 0.0040 |
| 7 | 3.62 | 3.15 | 0.030 | 2.90 | <0.01 | 18.0 | <0.01 | 18.0 | 5.40 | 0.51 | 1.04 | 0.0063 | 0.0043 |
| 8 | 1.74 | 3.15 | 0.033 | 2.88 | <0.01 | 17.9 | <0.01 | 17.8 | 5.42 | 0.99 | 0.99 | 0.0070 | 0.0050 |
| 9 | 0.91 | 3.15 | 0.028 | 2.88 | <0.01 | 17.8 | <0.01 | 17.7 | 5.46 | 1.34 | 0.69 | 0.0090 | 0.0040 |
| 10 | 15.5 | 4.00 | 0.030 | 2.88 | <0.01 | 18.0 | <0.01 | 18.2 | 5.37 | 0.20 | 1.71 | 0.0060 | 0.0040 |
| 11 | 4.09 | 4.00 | 0.032 | 2.88 | <0.01 | 18.0 | <0.01 | 18.1 | 5.42 | 0.65 | 1.47 | 0.0060 | 0.0040 |

TABLE 1-continued

CHEMICAL COMPOSITION OF TEST ALLOYS TO STUDY ALUMINUM AND TITANIUM EFFECTS

| Heat | Al/Ti (at %) | Al + Ti (at %) | Chemical Composition (wt %) C | Mo | W | Cr | Co | Fe | Nb | Ti | Al | P | B |
|---|---|---|---|---|---|---|---|---|---|---|---|---|---|
| 12 | 3.74 | 4.00 | 0.026 | 2.90 | <0.01 | 17.7 | 0.02 | 17.7 | 5.32 | 0.68 | 1.38 | 0.0060 | 0.0040 |
| 13 | 1.58 | 4.00 | 0.028 | 2.90 | <0.01 | 17.8 | <0.01 | 17.9 | 5.45 | 1.23 | 1.12 | 0.0090 | 0.0050 |
| 14 | 0.99 | 4.00 | 0.028 | 2.88 | <0.01 | 18.0 | <0.01 | 17.9 | 5.37 | 1.68 | 0.95 | 0.0060 | 0.0050 |
| 15 | 0.25 | 4.00 | 0.028 | 2.90 | <0.01 | 18.0 | <0.01 | 18.1 | 5.40 | 2.64 | 0.37 | 0.0050 | 0.0050 |
| 16 | 0.06 | 4.00 | 0.026 | 2.91 | <0.01 | 18.1 | <0.01 | 18.2 | 5.40 | 3.01 | 0.23 | 0.0060 | 0.0040 |

The mechanical properties are given in Table 2. In all of the following Tables, UTS refers to ultimate tensile strength, YS refers to yield strength, EL refers to elongation, and RA refers to reduction of area. All of the alloys were made by vacuum induction melting (VIM) and vacuum arc remelting (VAR) techniques that are well known to those of ordinary skill in the art. VAR was used to convert 50 pound VIM heats into 4 inch round ingots or, in some cases, 300 pound VIM heats into 8 inch ingots. The ingots were homogenized at 2175° F. (1191° C.) for 16 hours. The homogenized ingots were then forged into 2-inch by 2-inch billets, which were further rolled into ¾ inch bars. Test sample blanks were cut from rolled bars and heat treated using a typical heat treatment process for Alloy 718 (i.e., solution treatment at 1750° F. (954° C.) for 1 hour, air cool to room temperature, age at 1325° F. (718° C.) for 8 hours, furnace cool at 100° F. (56° C.) per hour to 1150° F. (621° C.), age at 1150° F. (621° C.) for 8 hours and then air cool to room temperature).

The grain size of all of the test alloys after heat treatment was in the range of ASTM grain sizes 9 to 11. To evaluate the thermal stability of the test alloys (i.e., the ability to retain mechanical properties after thermal exposure for a relatively long time period), as-heat treated alloys were further heat treated at 1300° F. (704° C.) for 1000 hours. Tensile tests at room temperature and elevated temperatures were performed per ASTM E8 and ASTM E21. Stress rupture tests at various temperatures and stress combinations were performed per ASTM E292, using specimen 5 (CSN-0.0075 radius notch).

TABLE 2

EFFECT OF ALUMINUM AND TITANIUM LEVELS ON THERMAL STABILITY

| Heat | Al/Ti (at %) | Al + Ti (at %) | Heat Treatment Condition | Tensile Properties 68° F. (20° C.) UTS (ksi) | YS (ksi) | El (%) | RA (%) | 1200° F. (649° C.) UTS (ksi) | YS (ksi) | El (%) | RA (%) | Stress Rupture 1250° F. (677° C.)/ 100 ksi Life (hrs) | El (%) | 1300° F. (704° C.)/ 90 ksi Life (hrs) | El (%) |
|---|---|---|---|---|---|---|---|---|---|---|---|---|---|---|---|
| 1 | 3.97 | 1.5 | As-HT | 203.2 | 168.5 | 24.2 | 48.0 | 167.3 | 143.1 | 28.5 | 65.6 | 18.8 | 30.5 | 10.7 | 32.0 |
| | | | HT +1300° F. (704° C.)/ 1000 h | 155.5 R = 0.77 | 87.8 R = 0.52 | 39.9 | 44.9 | 115.6 R = 0.69 | 71.5 R = 0.50 | 53.7 | 74.9 | 0.3 R = 0.02 | 42.9 | 0.2 R = 0.02 | 49.4 |
| 2 | 0.96 | 1.5 | As-HT | 210.1 | 172.9 | 24.3 | 42.5 | 171.2 | 145.8 | 30.6 | 71.3 | 21.0 | 33.5 | 9.2 | 36.5 |
| | | | HT +1300° F. (704° C.)/ 1000 h | 169.9 R = 0.81 | 109.2 R = 0.63 | 26.6 | 47.6 | 123.8 R = 0.72 | 90.0 R = 0.62 | 45.8 | 79.0 | 0.25 R = 0.01 | 39.5 | 0.2 R = 0.02 | 43.5 |
| 3 | 0.23 | 1.5 | As-HT | 211.2 | 169.3 | 21.4 | 40.2 | 171.2 | 149.2 | 33.8 | 71.4 | 21.0 | 33.5 | 9.2 | 36.5 |
| | | | HT +1300° F. (704° C.)/ 1000 h | 167.3 R = 0.79 | 107.4 R = 0.64 | 26.9 | 38.3 | 121.6 R = 0.71 | 85.9 R = 0.58 | 46.0 | 75.4 | 0.2 R = 0.01 | 38.9 | 0.1 R = 0.01 | 44.3 |
| 4 | 3.64 | 2.25 | As-HT | 206.8 | 163.8 | 24.3 | 44.4 | 172.4 | 140.1 | 26.3 | 62.4 | 38.4 | 27.5 | 20.3 | 33.5 |
| | | | HT +1300° F. (704° C.)/ 1000 h | 176.2 R = 0.85 | 107.7 R = 0.66 | 19.9 | 21.2 | 130.5 R = 0.76 | 85.9 R = 0.61 | 51.1 | 75.2 | 0.8 R = 0.02 | 53.1 | 0.5 R = 0.03 | 53.7 |
| 5 | 0.93 | 2.25 | As-HT | 214.4 | 174.6 | 23.0 | 40.6 | 175.0 | 150.6 | 30.9 | 64.7 | 37.0 | 34.9 | 11.3 | 36.2 |
| | | | HT +1300° F. (704° C.)/ 1000 h | 168.2 R = 0.79 | 101.2 R = 0.58 | 17.8 | 24.1 | 125.1 R = 0.71 | 77.3 R = 0.51 | 33.9 | 73.5 | 0.7 R = 0.02 | 40.3 | 0.3 R = 0.03 | 39.0 |
| 6 | 0.24 | 2.25 | As-HT | 217.3 | 175.5 | 18.7 | 37.3 | 176.0 | 149.1 | 24.4 | 49.3 | 28.5 | 27.0 | 16.7 | 30.0 |
| | | | HT +1300° F. (704° C.)/ 1000 h | 164.1 R = 0.76 | 97.1 R = 0.55 | 15.7 | 15.7 | 120.2 R = 0.68 | 75.0 R = 0.50 | 47.4 | 72.6 | 0.5 R = 0.02 | 40.7 | 0.2 R = 0.01 | 40.7 |

TABLE 2-continued

EFFECT OF ALUMINUM AND TITANIUM LEVELS ON THERMAL STABILITY

| | | | | Tensile Properties | | | | | | | | Stress Rupture | | | |
|---|---|---|---|---|---|---|---|---|---|---|---|---|---|---|---|
| | | | | 68° F. (20° C.) | | | | 1200° F. (649° C.) | | | | 1250° F. (677° C.)/ 100 ksi | | 1300° F. (704° C.)/ 90 ksi | |
| Heat | Al/Ti (at %) | Al + Ti (at %) | Heat Treatment Condition | UTS (ksi) | YS (ksi) | El (%) | RA (%) | UTS (ksi) | YS (ksi) | El (%) | RA (%) | Life (hrs) | El (%) | Life (hrs) | El (%) |
| 7 | 3.62 | 3.15 | As-HT | 215.7 | 166.8 | 23.4 | 44.3 | 175.1 | 139.1 | 25.2 | 50.1 | 48.6 | 35.0 | 8.7 | 39.0 |
| | | | HT +1300° F./ (704° C.)/ 1000 h | 203.1 | 153.6 | 14.0 | 18.1 | 162.6 | 127.3 | 39.5 | 75.4 | 14.0 | 35.0 | 2.6 | 41.9 |
| | | | | R = 0.94 | R = 0.92 | | | R = 0.93 | R = 0.91 | | | R = 0.29 | | R = 0.30 | |
| 8 | 1.74 | 3.15 | As-HT | 219.4 | 171.1 | 22.9 | 38.3 | 176.6 | 145.9 | 33.2 | 54.2 | 23.4 | 38.7 | 9.7 | 37.3 |
| | | | HT +1300° F. (704° C.)/ 1000 h | 205.7 | 154.4 | 9.0 | 9.6 | 164.4 | 129.0 | 42.5 | 72.9 | 4.3 | 40.4 | 2.4 | 41.0 |
| | | | | R = 0.94 | R = 0.90 | | | R = 0.93 | R = 0.88 | | | R = 0.18 | | R = 0.25 | |
| 9 | 0.91 | 3.15 | As-HT | 219.4 | 173.9 | 27.1 | 37.7 | 184.0 | 154.4 | 27.4 | 65.7 | 24.4 | 40.9 | 11.8 | 35.1 |
| | | | HT +1300° F. (704° C.)/ 1000 h | 210.7 | 156.0 | 11.4 | 14.1 | 167.3 | 133.4 | 31.0 | 69.3 | 4.4 | 38.5 | 2.1 | 47.7 |
| | | | | R = 0.96 | R = 0.89 | | | R = 0.91 | R = 0.86 | | | R = 0.18 | | R = 0.18 | |
| 10 | 15.5 | 4.00 | As-HT | 204.0 | 146.4 | 27.4 | 48.8 | 165.9 | 121.3 | 29.7 | 45.5 | 28.3 | 31.0 | 10.3 | 33.0 |
| | | | HT +1300° F. (704° C.)/ 1000 h | 194.5 | 137.6 | 12.2 | 13.8 | 163.2 | 117.2 | 39.7 | 66.0 | 9.9 | 45.4 | 6.7 | 39.1 |
| | | | | R = 0.95 | R = 0.94 | | | R = 0.98 | R = 0.97 | | | R = 0.35 | | R = 0.65 | |
| 11 | 4.09 | 4.00 | As-HT | 212.6 | 160.0 | 25.5 | 43.4 | 177.5 | 138.9 | 25.7 | 34.6 | 44.4 | 33.0 | 23.5 | 37.5 |
| | | | HT +1300° F. (704° C.)/ 1000 h | 209.3 | 153.1 | 14.4 | 13.8 | 175.6 | 129.6 | 31.6 | 66.0 | 10.2 | 34.9 | 7.8 | 37.7 |
| | | | | R = 0.98 | R = 0.96 | | | R = 0.99 | R = 0.93 | | | R = 0.23 | | R = 0.33 | |
| 12 | 3.74 | 4.00 | As-HT | 213.1 | 156.5 | 26.4 | 48.3 | 174.6 | 133.6 | 26.2 | 35.9 | 41.1 | 37.9 | 23.6 | 34.8 |
| | | | HT +1300° F. (704° C.)/ 1000 h | 212.3 | 161.5 | 15.2 | 17.9 | 170.6 | 134.5 | 33.6 | 68.5 | 8.9 | 40.6 | 7.0 | 40.7 |
| | | | | R = 1 | R > 1 | | | R = 0.98 | R > 1 | | | R = 0.22 | | R = 0.30 | |
| 13 | 1.58 | 4.00 | As-HT | 214.6 | 162.7 | 17.4 | 23.4 | 168.1 | 131.5 | 38.1 | 71.7 | 22.0 | 37.9 | 8.8 | 35.3 |
| | | | HT +1300° F. (704° C.)/ 1000 h | 207.9 | 156.5 | 7.8 | 8.5 | 161.3 | 122.5 | 35.0 | 73.9 | 4.4 | 43.4 | 2.9 | 45.8 |
| | | | | R = 0.97 | R = 0.96 | | | R = 0.96 | R = 0.89 | | | R = 0.20 | | R = 0.33 | |
| 14 | 0.99 | 4.00 | As-HT | 211.4 | 164.5 | 11.4 | 12.4 | 171.3 | 133.8 | 25.0 | 48.6 | 17.4 | 33.0 | 6.1 | 38.0 |
| | | | HT +1300° F. (704° C.)/ 1000 h | 183.5 | 133.5 | 5.4 | 7.0 | 147.5 | 107.0 | 42.1 | 60.1 | 1.4 | 49.3 | 0.7 | 40.4 |
| | | | | R = 0.87 | R = 0.81 | | | R = 0.86 | R = 0.80 | | | R = 0.08 | | R = 0.11 | |
| 15 | 0.25 | 4.00 | As-HT | 214.9 | 167.9 | 12.0 | 15.4 | 174.0 | 143.5 | 27.6 | 69.3 | 4.7 | 36.0 | 2.4 | 30.8 |
| | | | HT +1300° F. (704° C.)/ 1000 h | 164.9 | 133.7 | 2.0 | 4.7 | 139.7 | 96.3 | 38.5 | 77.0 | 0.5 | 37.0 | 0.4 | 44.7 |
| | | | | R = 0.77 | R = 0.80 | | | R = 0.80 | R = 0.67 | | | R = 0.11 | | R = 0.17 | |
| 16 | 0.06 | 4.00 | As-HT | 225.4 | 195.0 | 5.6 | 6.3 | 178.2 | 157.6 | 32.3 | 68.5 | 2.6 | 41.5 | 1.1 | 46.0 |
| | | | HT +1300° F. (704° C.)/ 1000 h | 182.0 | 143.2 | 3.1 | 0.6 | 135.3 | 100.6 | 58.5 | 81.0 | 0.4 | 42.0 | — | |
| | | | | R = 0.81 | R = 0.73 | | | R = 0.76 | R = 0.64 | | | R = 0.15 | | | |

Figure 2:
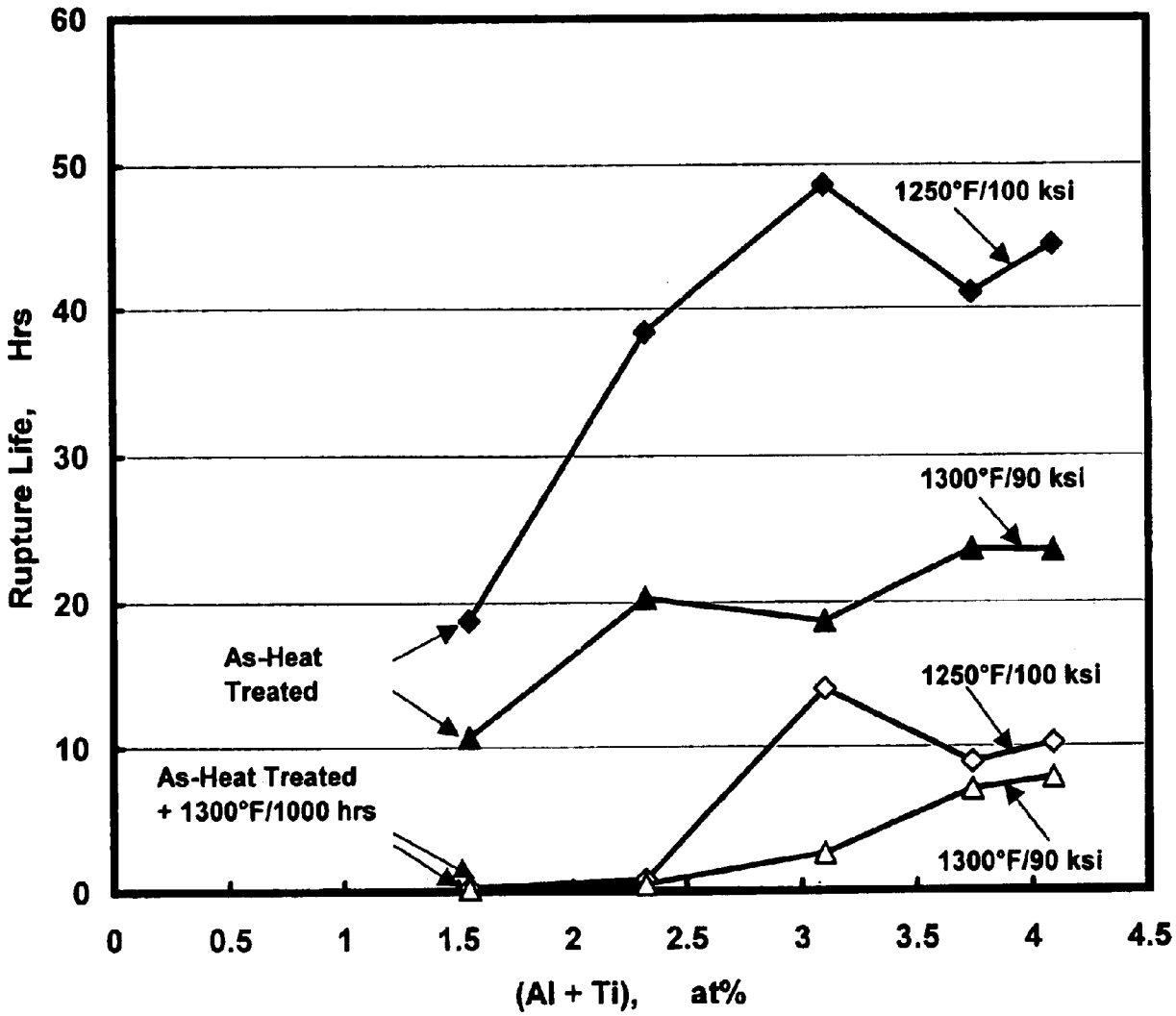
FIG. 2 is a plot of stress rupture life versus aluminum plus titanium atomic percentage for certain nickel-base alloys with a ratio of aluminum atomic percent to titanium atomic percent of 3.6–4.1.

The data reported in Table 2 is plotted in FIGS. 1 to 4. As is seen in FIGS. 1 and 2, the stress rupture properties of the test alloys appeared to improve as the quantity of the (Al+Ti), and therefore the quantity of γ', increased. The improvement was most dramatic up to (Al+Ti)=3.0. As shown in Table 2, thermal stability, as measured by the ratio of mechanical properties of the alloy as heat-treated to the mechanical properties of the alloy after a 1000 hour thermal exposure at 1300° F. (704° C.) (retention ratio, R), also appeared to improve with increasing quantity of (Al+Ti). The useful upper limit of the contents of aluminum and titanium is restricted, however, by processing considerations. Specifically, excessively high levels of aluminum and titanium negatively impact workability and weldability. Thus, it appears to be desirable to maintain the aluminum plus titanium content for a hot workable and weldable nickel-base alloy between about 2 and about 6 atomic percent or, in some cases, between about 2.5 and 5 atomic percent or between about 3 and 4 atomic percent.

Figure 3:
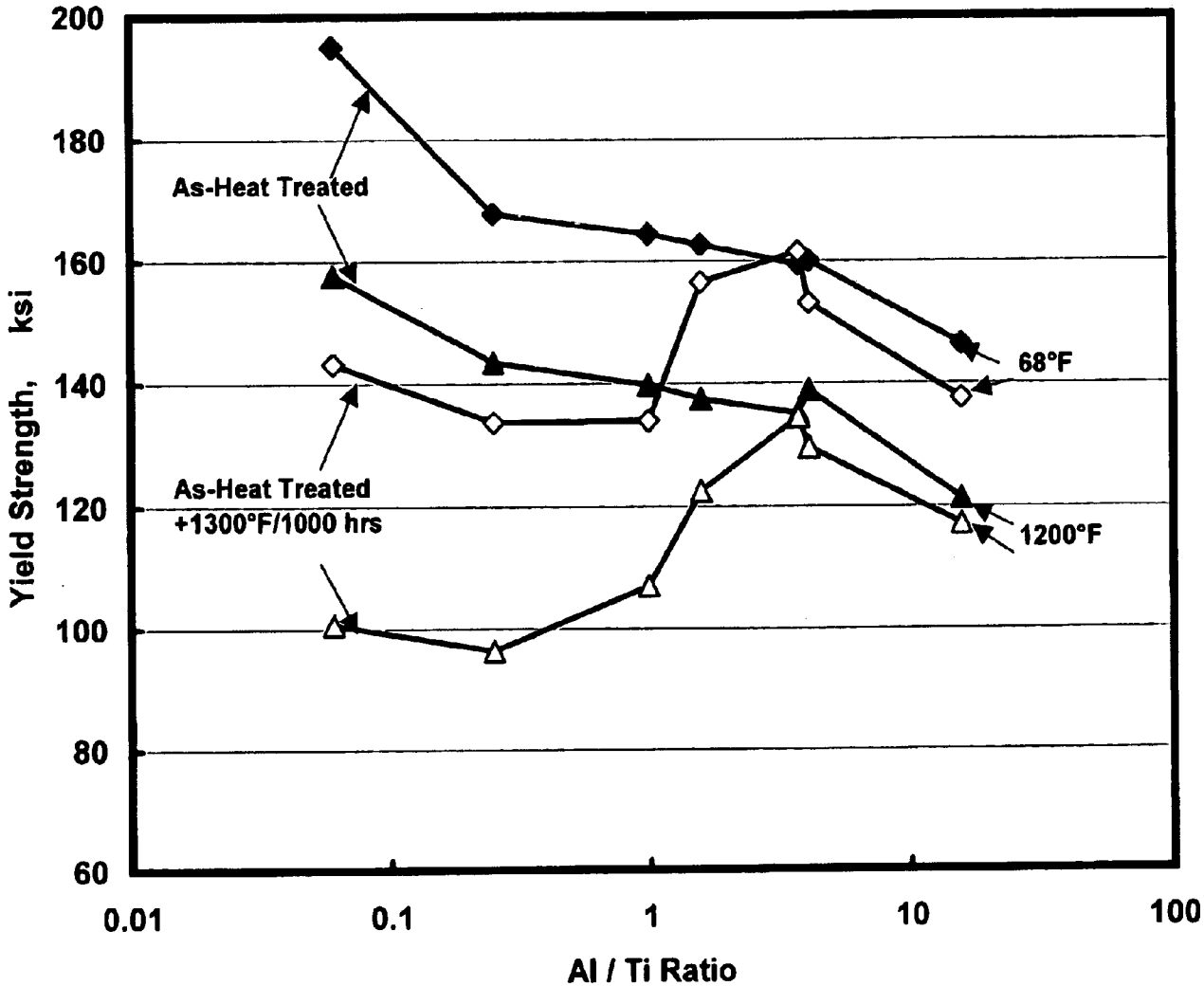
FIG. 3 is a plot of yield strength versus ratios of aluminum atomic percent to titanium atomic percent for certain nickel-base alloys including about 4 atomic percent aluminum plus titanium.
Figure 4:
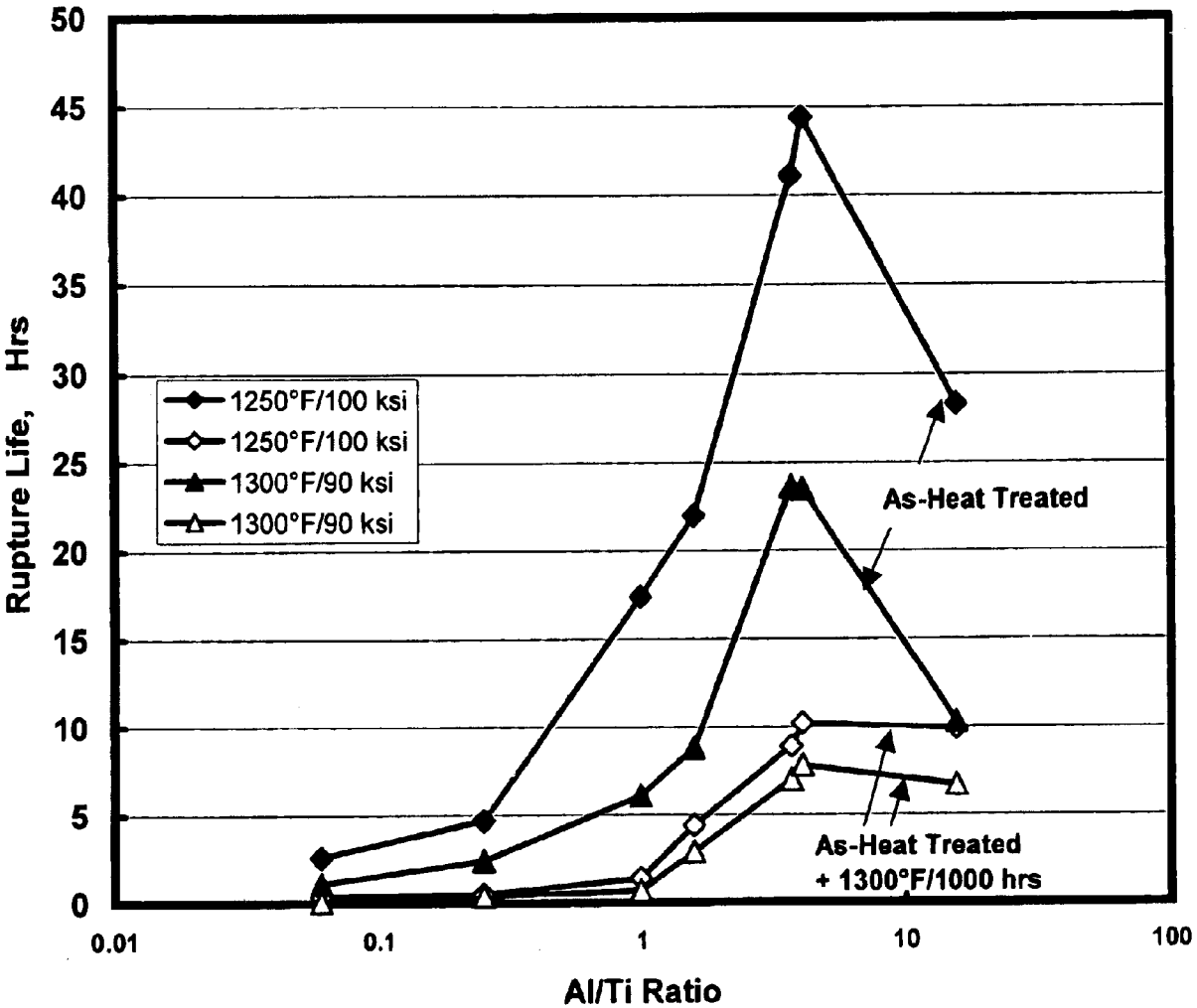
FIG. 4 is a plot of stress rupture life at 1300° F. (704° C.) and 90 ksi and 1250° F. (677° C.) and 100 ksi versus ratios of aluminum atomic percent to titanium atomic percent for certain nickel-base alloys including about 4 atomic percent aluminum plus titanium.

Now referring to FIG. 3, it is seen that the ratio of atomic percent aluminum to atomic percent titanium also appeared to influence the mechanical properties and thermal stability of the test alloys. Specifically, a lower aluminum to titanium ratio appeared to result in higher yield strengths of the alloys in the as heat treated state. As seen in FIG. 4, however, higher atomic percent aluminum to atomic percent titanium ratios appeared to improve stress rupture life in the test alloys and a peak in stress rupture life was seen at an aluminum atomic percent to titanium atomic percent ratio of about 3 to 4. From these Figures and Table 2, it appears that higher aluminum atomic percent to titanium atomic percent ratios generally improved the thermal stability of the test alloys. As a result, while a low aluminum to titanium ratio is typically used in Alloy 718-type alloys due to strength considerations, such compositions do not appear to be favorable from a stress rupture life or thermal stability standpoint. The useful limit of the aluminum atomic percent to titanium atomic percent ratio is generally limited by the desire for high strength and processing characteristics, such as hot workability or weldability. Preferably, in accordance with certain embodiments of the present invention, the aluminum to titanium atomic percent ratio is at least about 1.5 or in some cases, between about 2 and about 4 or between about 3 and about 4.

The effect of varying the ratio of aluminum atomic percent to titanium atomic percent in alloys including phosphorous, boron, iron, niobium, cobalt and tungsten compositions within various embodiments of the present invention was also measured. The compositions of the alloys tested are listed in Table 3.

TABLE 3

CHEMICAL COMPOSITION OF TEST ALLOYS TO STUDY ALUMINUM AND TITANIUM EFFECTS

| | Chemical Composition (wt %) | | | | | | | | | | |
|---|---|---|---|---|---|---|---|---|---|---|---|
| Heat | C | Mo | W | Cr | Co | Fe | Nb | Ti | Al | P | B |
| GROUP 1:5% Co | | | | | | | | | | | |
| 1 | 0.029 | 2.91 | <0.01 | 17.9 | 4.96 | 9.96 | 5.34 | 0.98 | 0.55 | 0.018 | 0.009 |
| 2 | 0.026 | 2.90 | <0.01 | 17.9 | 4.97 | 10.0 | 5.31 | 0.65 | 1.41 | 0.017 | 0.009 |
| 3 | 0.028 | 2.86 | <0.01 | 17.9 | 4.96 | 10.2 | 5.31 | 0.99 | 1.40 | 0.018 | 0.009 |
| GROUP 2:9% Co. 1% W | | | | | | | | | | | |
| 4 | 0.032 | 2.89 | 0.89 | 17.9 | 9.16 | 9.93 | 5.40 | 0.46 | 0.90 | 0.008 | 0.005 |
| 5 | 0.026 | 2.89 | 1.06 | 17.8 | 8.90 | 9.86 | 5.51 | 1.03 | 0.53 | 0.008 | 0.004 |
| 6 | 0.028 | 2.89 | 1.01 | 17.9 | 9.12 | 9.98 | 5.38 | 0.56 | 1.20 | 0.009 | 0.005 |
| 7 | 0.030 | 2.88 | 1.00 | 17.9 | 8.94 | 9.95 | 5.35 | 1.64 | 0.93 | 0.008 | 0.003 |
| 8 | 0.031 | 2.88 | 1.02 | 17.4 | 8.90 | 9.92 | 5.47 | 0.64 | 1.45 | 0.007 | 0.005 |

The mechanical properties of samples of the alloys listed in Table 3 are given in Table 4. The test samples listed in Tables 3 and 4 were processed, heat treated and tested in the same manner as discussed earlier with respect to Tables 1 and 2.

TABLE 4

EFFECT OF ALUMINUM AND TITANIUM LEVELS ON THERMAL STABILITY OF TEST ALLOYS

| | | | | | | Tensile Properties | | | | | | | | Stress Rupture | |
|---|---|---|---|---|---|---|---|---|---|---|---|---|---|---|---|
| | | | | | | 68° F. (20° C.) | | | | 1300° F. (704° C.) | | | | 1300° F. (704° C.)/ 90 ksi | |
| Heat | Ti (wt %) | Al (wt %) | Al + Ti (at %) | Al/ Ti (at %) | Heat Treatment Condition | UTS (ksi) | YS (ksi) | El (%) | RA (%) | UTS (ksi) | YS (ksi) | El (%) | RA (%) | Life (hrs) | El (%) |
| GROUP 1:5% Co | | | | | | | | | | | | | | | |
| 1 | 0.98 | 0.55 | 2.38 | 1.00 | As-HT | 216.6 | 164.3 | 25.9 | 43.9 | 147.1 | 122.6 | 30.1 | 36.0 | 62.8 | 40.0 |
| | | | | | HT + 1300° F. | 192.4 | 135.5 | 21.2 | 25.8 | 120.5 | 99.7 | 54.4 | 80.1 | 6.9 | 53.7 |
| | | | | | (704° C.)/ 1000 h | R = 0.89 | R = 0.82 | | | R = 0.82 | R = 0.81 | | | R = 0.11 | |
| 2 | 0.65 | 1.41 | 3.80 | 3.85 | As-HT | 209.2 | 152.8 | 27.9 | 53.5 | 164.1 | 126.8 | 18.9 | 22.6 | 166.5 | 32.5 |
| | | | | | HT + 1300° F. | 202.7 | 142.6 | 26.4 | 41.8 | 151.5 | 126.9 | 37.6 | 60.3 | 77.3 | 42.0 |
| | | | | | (704° C.)/ 1000 h | R = 0.97 | R = 0.93 | | | R = 0.92 | R = 1 | | | R = 0.46 | |
| 3 | 0.99 | 1.40 | 4.18 | 2.51 | As-HT | 222.4 | 166.8 | 10.1 | 9.4 | 157.7 | 131.9 | 40.0 | 72.9 | 29.7 | 51.7 |
| | | | | | HT + 1300° F. | 205.7 | 145.1 | 10.8 | 14.2 | 129.4 | 104.1 | 56.3 | 83.3 | 3.6 | 50.2 |
| | | | | | (704° C.)/ 1000 h | R = 0.92 | R = 0.87 | | | R = 0.82 | R = 0.79 | | R > 1 | R = 0.12 | |

TABLE 4-continued

EFFECT OF ALUMINUM AND TITANIUM LEVELS ON THERMAL STABILITY OF TEST ALLOYS

| Heat | Ti (wt %) | Al (wt %) | Al + Ti (at %) | Al/Ti (at %) | Heat Treatment Condition | Tensile Properties 68° F. (20° C.) UTS (ksi) | YS (ksi) | El (%) | RA (%) | 1300° F. (704° C.) UTS (ksi) | YS (ksi) | El (%) | RA (%) | Stress Rupture 1300° F. (704° C.)/90 ksi Life (hrs) | El (%) |
|---|---|---|---|---|---|---|---|---|---|---|---|---|---|---|---|
| GROUP 2:9% Co. 1% W | | | | | | | | | | | | | | | |
| 4 | 0.46 | 0.90 | 2.51 | 3.48 | As-HT | 191.3 | 130.7 | 36.8 | 53.4 | 133.7 | 100.3 | 19.1 | 18.2 | 114.0 | 17.9 |
| | | | | | HT + 1300° F. (704° C.)/1000 h | 179.5 R = 0.94 | 114.4 R = 0.88 | 34.2 | 53.6 | 135.2 R > 1 | 101.0 R > 1 | 29.2 | 28.8 | 123.7 R > 1 | 40.8 |
| 5 | 1.03 | 0.53 | 2.42 | 0.92 | As-HT | 206.7 | 150.8 | 27.9 | 41.8 | 146.6 | 118.1 | 18.1 | 21.7 | 97.0 | 28.2 |
| | | | | | HT + 1300° F. (704° C.)/1000 h | 195.1 R = 0.93 | 135.9 R = 0.90 | 26.9 | 36.4 | 143.1 R = 0.98 | 120.3 R > 1 | 30.4 | 35.8 | 87.9 R = 0.91 | 33.4 |
| 6 | 0.56 | 1.20 | 3.27 | 3.81 | As-HT | 203.6 | 144.8 | 32.5 | 53.3 | 140.4 | 111.6 | 14.0 | 15.0 | 141.4 | 42.3 |
| | | | | | HT + 1300° F. (704° C.)/1000 h | 189.7 R = 0 93 | 126.9 R = 0.88 | 32.2 | 50.8 | 148.0 R > 1 | 115.1 R > 1 | 21.4 | 25.8 | 177.4 R > 1 | 26.6 |
| 7 | 1.64 | 0.93 | 4.01 | 1.00 | As-HT | 200.8 | 130.0 | 15.9 | 14.4 | 146.4 | 100.1 | 33.2 | 44.7 | 58.9 | 39.8 |
| | | | | | HT + 1300° F. (704° C.)/1000 h | 187.6 R = 0.93 | 124.9 R = 0.96 | 13.6 | 11.2 | 137.0 R = 0.94 | 97.9 R = 0.97 | 47.5 | 76.3 | 30.3 R = 0.51 | 39.9 |
| 8 | 0.64 | 1.45 | 3.92 | 3.96 | As-HT | 210.1 | 147.5 | 26.8 | 40.9 | 151.6 | 119.0 | 13.7 | 14.7 | 115.0 | 36.0 |
| | | | | | HT + 1300° F. (704° C.)/ | 204.9 R = 0.98 | 140.0 R = 0.95 | 26.8 | 35.2 | 151.7 R > 1 | 121.7 R > 1 | 21.8 | 23.1 | 176.3 R > 1 | 50.8 |

Figure 5:
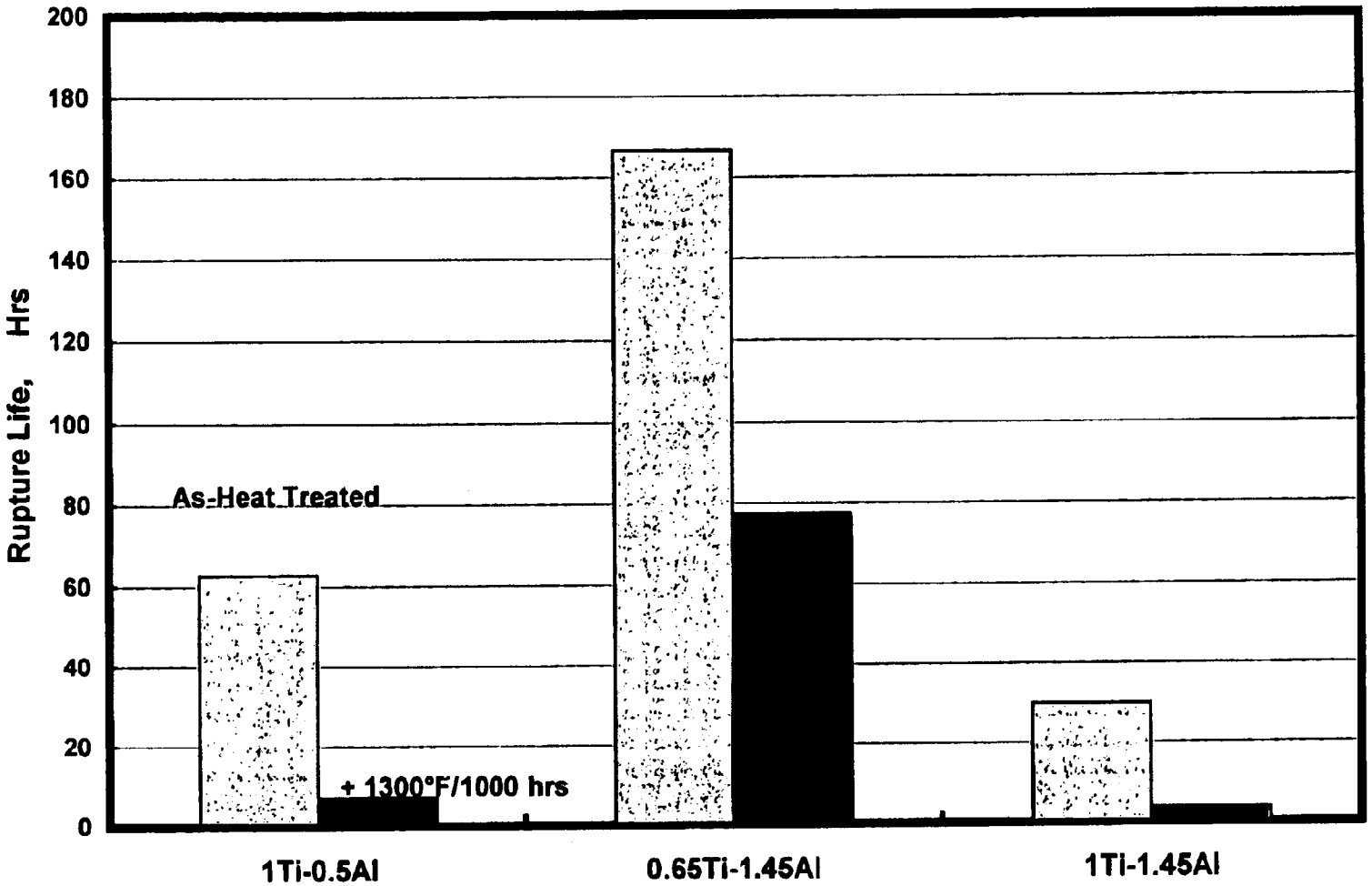
FIG. 5 is a plot of stress rupture life at 1300° F. (704° C.) and 80 ksi for certain nickel-base alloys including varying contents of aluminum and titanium and about 5 weight percent cobalt.
Figure 6:
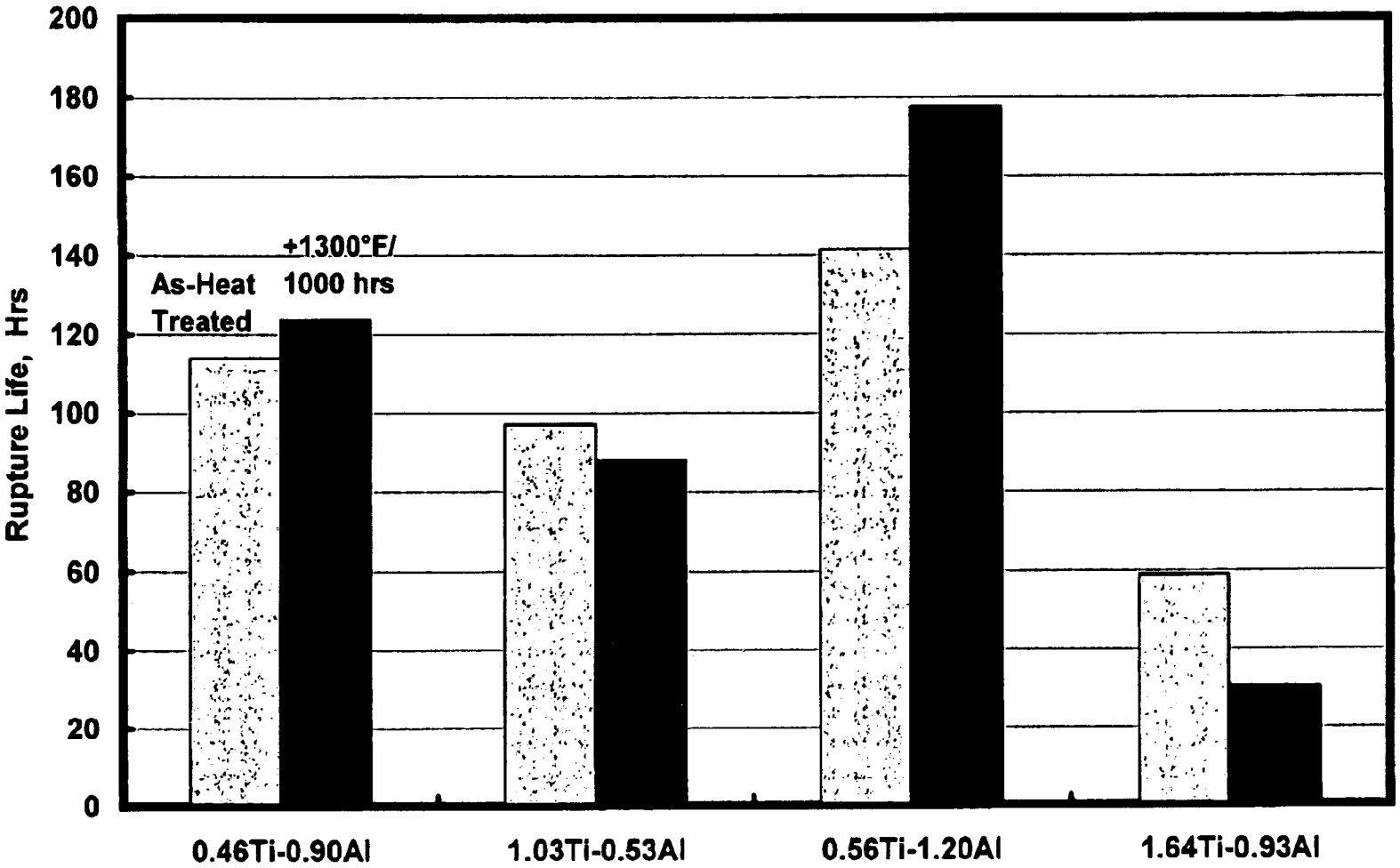
FIG. 6 is a plot of stress rupture life at 1300° F. (704° C.) and 80 ksi for certain nickel-base alloys including varying contents of aluminum and titanium and about 9 weight percent cobalt.

The data reported in Table 4 is plotted in FIGS. 5 and 6, where it is seen that Heat 2, of Table 3, which contained 1.41 percent aluminum and 0.65 percent titanium, and had the largest aluminum to titanium ratio (about 3.85 based on atomic percentages), exhibited the most favorable stress rupture properties and higher retention rate, R, of the alloys of Table 3 containing 5%, by weight, cobalt (Heats 1 to 3). A similar trend was observed in the alloys containing 9%, by weight, cobalt (Heats 4 to 8). Specifically, it is apparent from Table 4 and FIG. 6, that Heats 4, 6, and 8, which contained higher aluminum to titanium ratios, exhibited superior stress rupture properties to Heats 5 and 7. Thus, in accordance with certain embodiments of the present invention, the nickel-base alloy may include about 0.9 up to about 2.0 weight percent aluminum and/or about 0.45 up to about 1.4 weight percent titanium. Alternatively, in accordance with certain embodiments of the present invention, the nickel-base alloy may include about 1.2 to about 1.5 weight percent aluminum and/or 0.55 to about 0.7 weight percent titanium.

A number of alloys were also made to study the effect of including phosphorous and boron in amounts within the present invention. Two groups of alloys were made as listed in Table 5. The Group 1 alloys were made to investigate the effect of phosphorous and boron variations with aluminum and titanium contents adjusted to about 1.45 weight percent aluminum and 0.65 weight percent titanium. The Group 2 alloys were made to investigate the effect of phosphorous and boron in alloys with the n and cobalt levels also adjusted to amounts within the present invention.

TABLE 5

CHEMICAL COMPOSITION OF TEST ALLOYS TO STUDY PHOSPHOROUS AND BORON EFFECTS

| Heat | Chemical Composition (wt %) C | Mo | W | Cr | Co | Fe | Nb | Ti | Al | P | B |
|---|---|---|---|---|---|---|---|---|---|---|---|
| GROUP 1: 1.45% Al and 0.65% Ti | | | | | | | | | | | |
| 1 | 0.032 | 2.88 | <0.01 | 18.0 | 0.02 | 17.9 | 5.31 | 0.68 | 1.41 | <0.0030 | 0.0040 |
| 2 | 0.026 | 2.90 | <0.01 | 17.7 | 0.02 | 17.7 | 5.32 | 0.68 | 1.43 | 0.0060 | 0.0040 |
| 3 | 0.028 | 2.91 | <0.01 | 18.0 | <0.01 | 17.9 | 5.43 | 0.66 | 1.38 | 0.0080 | 0.0040 |
| 4 | 0.026 | 2.90 | <0.01 | 17.9 | <0.01 | 17.8 | 5.32 | 0.64 | 1.40 | 0.0160 | 0.0100 |
| 5 | 0.030 | 2.91 | <0.01 | 18.0 | <0.01 | 17.9 | 5.42 | 0.66 | 1.40 | 0.0220 | 0.0090 |
| GROUP 2:1.45% Al, 0.65% Ti, 10% Fe, and 9% Co | | | | | | | | | | | |
| 6 | 0.030 | 2.89 | <0.01 | 18.0 | 8.96 | 10.2 | 5.37 | 0.64 | 1.45 | 0.0050 | 0.0040 |
| 7 | 0.028 | 2.87 | <0.01 | 17.8 | 8.90 | 9.95 | 5.45 | 0.65 | 1.46 | 0.0111 | 0.0041 |
| 8 | 0.028 | 2.91 | <0.01 | 18.1 | 8.98 | 10.1 | 5.50 | 0.65 | 1.48 | 0.0150 | 0.0039 |

TABLE 5-continued

CHEMICAL COMPOSITION OF TEST ALLOYS TO STUDY PHOSPHOROUS AND BORON EFFECTS

| | Chemical Composition (wt %) | | | | | | | | | | |
|---|---|---|---|---|---|---|---|---|---|---|---|
| Heat | C | Mo | W | Cr | Co | Fe | Nb | Ti | Al | P | B |
| 9 | 0.027 | 2.91 | <0.01 | 18.1 | 8.99 | 10.1 | 5.51 | 0.65 | 1.47 | 0.0210 | 0.0040 |
| 10 | 0.028 | 2.89 | <0.01 | 17.9 | 8.95 | 10.0 | 5.50 | 0.65 | 1.45 | 0.0107 | 0.0081 |
| 11 | 0.024 | 2.90 | <0.01 | 18.0 | 9.24 | 10.1 | 5.34 | 0.65 | 1.48 | 0.0140 | 0.0073 |
| 12 | 0.029 | 2.88 | <0.01 | 17.9 | 8.98 | 10.2 | 5.38 | 0.65 | 1.45 | 0.0180 | 0.0090 |

The mechanical properties of the alloys listed in Table 5 are given in Table 6. The test samples listed in Tables 5 and 6 were processed, heat treated and tested in the same manner as discussed earlier with respect to Tables 1 and 2.

TABLE 6

EFFECT OF PHOSPHOROUS AND BORON LEVELS ON MECHANICAL PROPERTIES

| | | | Tensile Properties | | | | | | | | Stress Rupture | | | |
|---|---|---|---|---|---|---|---|---|---|---|---|---|---|---|
| | | | 68° F. (20° C.) | | | | 1200° F. (649° C.) | | | | 1250° F. (677° C.)/100 ksi | | 1300° F. (704° C.)/ 90 ksi* | |
| Heat | P (wt %) | B (wt %) | UTS (ksi) | YS (ksi) | El (%) | RA (%) | UTS (ksi) | YS (ksi) | El (%) | RA (%) | Life (hrs) | El (%) | Life (hrs) | El (%) |
| GROUP 1: 1.45% Al 0.65% Ti | | | | | | | | | | | | | | |
| 1 | 0.003 | 0.004 | 211.3 | 157.4 | 27.1 | 49.7 | 174.9 | 136.5 | 24.1 | 27.3 | 14.2 | 29.0 | 10.9 | 20.7 |
| 2 | 0.006 | 0.004 | 213.1 | 157.2 | 26.4 | 48.3 | 174.6 | 133.6 | 26.2 | 35.9 | 41.1 | 37.9 | 17.1 | 34.8 |
| 3 | 0.008 | 0.004 | 214.8 | 164.5 | 24.6 | 44.8 | 176.6 | 140.0 | 27.8 | 43.7 | 47.3 | 35.0 | 23.6 | 46.8 |
| 4 | 0.016 | 0.009 | 212.3 | 160.1 | 26.1 | 50.8 | 177.1 | 136.9 | 28.3 | 42.4 | 97.4 | 30.7 | 24.9 | 38.2 |
| 5 | 0.022 | 0.009 | 214.1 | 166.0 | 23.5 | 43.2 | 178.3 | 142.3 | 24.5 | 31.5 | 29.7 | 43.7 | 17.7 | 42.3 |
| GROUP 2:1 45% Al 0.65% Ti 10% Fe, and 9% Co | | | | | | | | | | | | | | |
| 6 | 0.005 | 0.004 | 217.9 | 162.1 | 25.5 | 43.8 | 191.2 | 140.5 | 22.3 | 30.2 | 107.0 | 39.5 | 67.7 | 47.4 |
| 7 | 0.012 | 0.004 | 225.6 | 169.5 | 23.4 | 33.8 | 196.7 | 144.1 | 28.8 | 54.2 | 172.5 | 28.0 | 129.5 | 35.5 |
| 8 | 0.015 | 0.004 | 217.0 | 179.5 | 24.8 | 38.4 | 193.5 | 144.9 | 27.6 | 38.9 | 196.0 | 37.0 | 214.0 | 39.5 |
| 9 | 0.021 | 0.004 | 218.9 | 160.5 | 25.8 | 38.6 | 194.2 | 139.6 | 25.7 | 30.5 | 145.1 | 29.5 | 188.0 | 37.5 |
| 10 | 0.011 | 0.008 | 215.1 | 154.9 | 26.0 | 39.3 | 191.4 | 134.5 | 26.5 | 37.9 | 206.0 | 41.0 | 141.5 | 41.0 |
| 11 | 0.014 | 0.0073 | 218.5 | 161.5 | 26.7 | 44.3 | 189.8 | 136.6 | 26.6 | 39.2 | 307.0 | 33.0 | 255.0 | 41.0 |
| 12 | 0.018 | 0.010 | 216.1 | 160.4 | 26.4 | 47.5 | 189.9 | 139.7 | 22.6 | 27.3 | 338.0 | 31.0 | 263.8 | 38.7 |

*The test stress for the group 2 alloys was 80 ksi at 1300° F. (704° C.).

Figure 7:
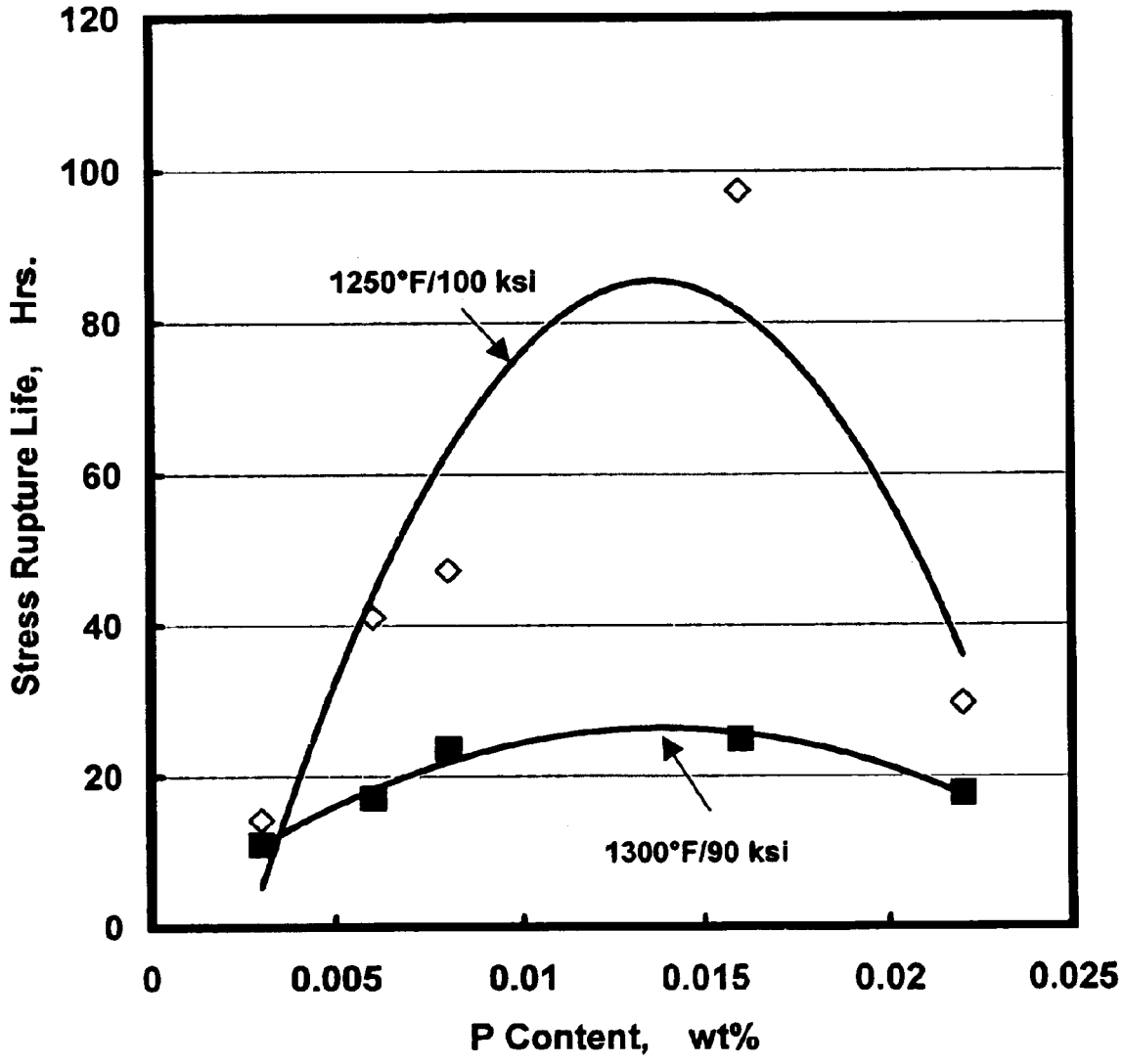
FIG. 7 is a plot of stress rupture life versus phosphorous content for certain nickel-base alloys including about 1.45 weight percent aluminum and about 0.65 weight percent titanium.
Figure 8:
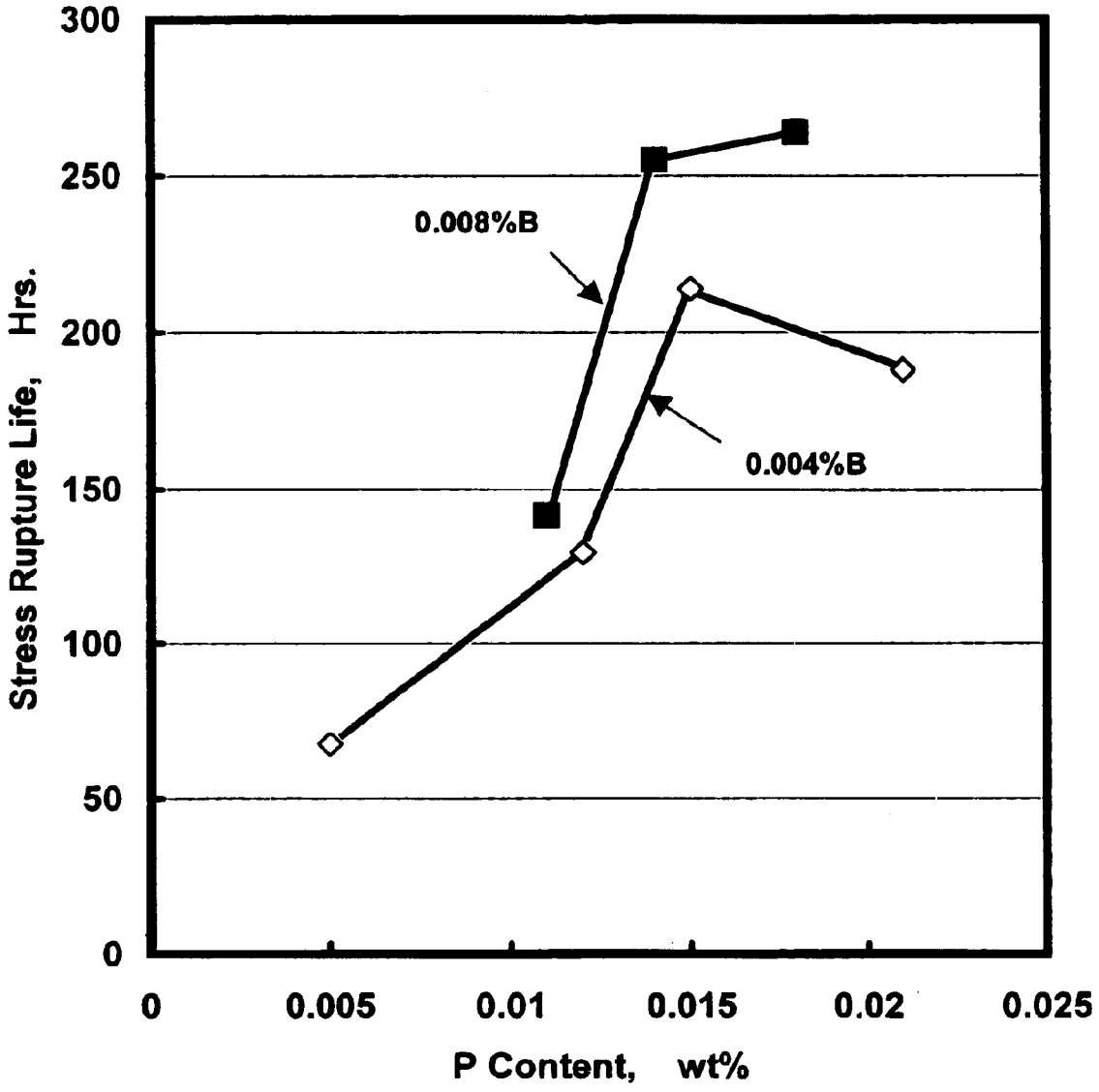
FIG. 8 is a plot of stress rupture life at 1300° F. (704° C.) and 80 ksi versus phosphorous content for certain nickel-base alloys including about 10 weight percent iron, about 9 weight percent cobalt, about 1.45 weight percent aluminum and about 0.65 weight percent titanium.

The data reported in Table 6 is plotted in FIGS. 7 and 8. As is apparent from Table 6 and FIGS. 7 and 8, the phosphorous content appears to have a significant effect on stress rupture properties. For example, there appeared to be a significant difference in stress rupture life between Heat 1 of Table 6, which has a phosphorous content outside the about 0.003 percent to about 0.03 percent range of the present invention, and the remaining Heats in Table 6, which have phosphorous contents within the range of the present invention. There also appears to be a phosphorous range wherein the stress rupture life is optimized. This range includes about 0.01 to about 0.02 weight percent phosphorous. All of the test Heats of Table 6 contain boron in amounts within the about 0.003 to about 0.015 percent range of the present invention. Thus, in accordance with certain embodiments of the present invention, the nickel-base alloy may include about 0.005 up to about 0.025 weight percent phosphorous, or, alternatively, about 0.01 to about 0.02 weight percent phosphorus. The nickel-base alloy may include about 0.004 up to about 0.011 weight percent boron, or, alternatively, about 0.006 up to about 0.008 weight percent boron.

Tests were also run to evaluate the effect of phosphorous and boron on the hot workability of embodiments of the nickel-base alloy of the present invention. No significant effect was found within the range of normal forging temperatures.

It also appears that the mechanical properties of 718-type alloys can be further improved by adjusting the amounts of iron and cobalt. A nickel-base alloy that includes advantageous amounts of iron and cobalt that appears to yield good strength, creep/stress rupture resistance, thermal stability and processing characteristics is within the present invention. Specifically, one aspect of the present invention is directed to a nickel-base alloy that includes about 5 weight percent up to about 12 weight percent cobalt (alternatively about 5 up to about 10 percent or about 8.75 to about 9.25 percent), and less than 14 percent (alternatively about 6 to about 12 percent or about 9 to about 11 percent), iron.

A number of test alloys were prepared to examine the effects of iron and cobalt content on mechanical properties. The compositions of these test alloys are listed in Table 7. These test alloys were divided into four groups based on the cobalt content, and the iron content was varied from 0 to 18 weight percent within each group. The alloys were prepared with the aluminum and titanium contents adjusted to about 1.45 weight percent aluminum and 0.65 weight percent titanium, as previously discussed. The phosphorous and boron contents were maintained within about 0.01 to about 0.02 and about 0.004 to about 0.11 weight percent, respectively.

TABLE 7

CHEMICAL COMPOSITION OF TEST ALLOYS WITH TO STUDY IRON AND COBALT EFFECTS

| | Chemical Composition (wt %) | | | | | | | | | | |
|---|---|---|---|---|---|---|---|---|---|---|---|
| Heat | C | Mo | W | Cr | Co | Fe | Nb | Ti | Al | P | B |
| GROUP 1: 0% wt % Cobalt | | | | | | | | | | | |
| 1 | 0.026 | 2.90 | <0.01 | 17.91 | <0.01 | 17.78 | 5.32 | 0.64 | 1.40 | 0.0160 | 0.0100 |
| 2 | 0.026 | 2.91 | <0.01 | 17.97 | 0.03 | 9.97 | 5.35 | 0.64 | 1.41 | 0.0167 | 0.0082 |
| 3 | 0.027 | 2.88 | <0.01 | 18.27 | <0.01 | 0.49 | 5.38 | 0.66 | 1.43 | 0.0170 | 0.0060 |
| GROUP 2: 3 wt % Co | | | | | | | | | | | |
| 4 | 0.025 | 2.88 | <0.01 | 17.96 | 3.00 | 18.09 | 5.30 | 0.64 | 1.41 | 0.0139 | 0.0107 |
| 5 | 0.031 | 2.85 | <0.01 | 17.85 | 2.97 | 13.96 | 5.27 | 0.65 | 1.41 | 0.0153 | 0.0095 |
| 6 | 0.027 | 2.86 | <0.01 | 17.75 | 2.96 | 9.99 | 5.26 | 0.73 | 1.34 | 0.0154 | 0.0083 |
| GROUP 3: 5 wt% Co | | | | | | | | | | | |
| 7 | 0.026 | 2.87 | <0.01 | 17.98 | 5.01 | 18.08 | 5.29 | 0.65 | 1.40 | 0.0140 | 0.0105 |
| 8 | 0.028 | 2.87 | <0.01 | 17.98 | 4.98 | 14.18 | 5.27 | 0.64 | 1.41 | 0.0122 | 0.0088 |
| 9 | 0.026 | 2.90 | <0.01 | 17.93 | 4.97 | 10.02 | 5.31 | 0.65 | 1.41 | 0.0170 | 0.0090 |
| 10 | 0.024 | 2.88 | <0.01 | 18.13 | 5.02 | 0.30 | 5.40 | 0.65 | 1.45 | 0.0161 | 0.0055 |
| GROUP 4: 9% Co | | | | | | | | | | | |
| 11 | 0.025 | 2.87 | <0.01 | 17.88 | 8.93 | 18.03 | 5.45 | 0.67 | 1.43 | 0.0170 | 0.0090 |
| 12 | 0.024 | 2.90 | <0.01 | 18.00 | 9.24 | 10.10 | 5.34 | 0.65 | 1.48 | 0.0140 | 0.0073 |
| 13 | 0.027 | 2.87 | <0.01 | 17.98 | 8.95 | 0.30 | 5.38 | 0.65 | 1.44 | 0.0160 | 0.0070 |

The mechanical properties of samples of the alloys listed in Table 7 are given in Table 8. The test samples listed in Tables 7 and 8 were processed, heat treated and tested in the same manner as discussed earlier with respect to Tables 1 and 2.

TABLE 8

EFFECT OF IRON AND COBALT LEVELS ON MECHANICAL PROPERTIES

| | | | | Tensile Properties | | | | | | | | Stress Rupture | | | |
|---|---|---|---|---|---|---|---|---|---|---|---|---|---|---|---|
| | | | | 68° F. (20° C.) | | | | 1200° F. (649° C.) | | | | 1250° F. (677° C.)/ 100 ksi | | 1300° F. (704° C.)/ 90 ksi | |
| Heat | Fe (wt %) | Co (wt %) | Heat Treatment Condition | UTS (ksi) | YS (ksi) | El (%) | RA (%) | UTS (ksi) | YS (ksi) | El (%) | RA (%) | Life (hrs) | El (%) | Life (hrs) | El (%) |
| GROUP 1: 0 wt % Co | | | | | | | | | | | | | | | |
| 1 | 17.78 | <0.01 | As-HT | 212.3 | 160.1 | 26.1 | 50.8 | 177.1 | 136.9 | 28.3 | 42.4 | 47.8 | 30.7 | 24.9 | 38.2 |
| | | | HT +1300° F. (704° C.)/ 1000 h | 207.6 R = 0.98 | 154.6 R = 0.97 | 12.6 | 11.9 | 171.6 R = 0.97 | 133.9 R = 0.98 | 36.6 | 64.6 | 13.3 R = 0.28 | 38.5 | 7.0 R = 0.28 | 38.6 |
| 2 | 9.97 | 0.03 | As-HT | 210.9 | 159.6 | 27.0 | 51.4 | 183.6 | 140.3 | 19.3 | 24.0 | 61.4 | 16.5 | 0.4 | NB |
| | | | HT +1300° F. (704° C.)/ 1000 h | 205.8 R = 0.98 | 153.5 R = 0.96 | 25.6 | 45.3 | 168.6 R = 0.92 | 130.9 R = 0.93 | 24.0 | 25.6 | 11.9 R = 0.19 | 19.7 | 6.5 | 33.6 |
| 3 | 0.49 | <0.01 | As-HT | 208.0 | 163.6 | 29.2 | 50.7 | 176.9 | 142.4 | 15.0 | 17.1 | 0.15 | NB* | 0.0 | NB* |
| | | | HT +1300° F. (704° C.)/ 1000 h | 188.3 R = 0.91 | 109.8 R = 0.67 | 29.6 | 44.2 | 143.1 R = 0.81 | 90.2 R = 0.63 | 36.6 | 36.7 | 1.25 R > 1 | 46.9 | 0.8 — | 57.7 |
| GROUP 2: 3 wt % Co | | | | | | | | | | | | | | | |
| 4 | 18.09 | 3.00 | As-HT | 219.5 | 168.8 | 21.4 | 44.5 | 184.5 | 145.8 | 19.1 | 27.0 | 25.9 | 35.5 | 12.7 | 43.0 |

TABLE 8-continued

EFFECT OF IRON AND COBALT LEVELS ON MECHANICAL PROPERTIES

| | | | | Tensile Properties | | | | | | | | Stress Rupture | | | |
|---|---|---|---|---|---|---|---|---|---|---|---|---|---|---|---|
| | | | | 68° F. (20° C.) | | | | 1200° F. (649° C.) | | | | 1250° F. (677° C.)/ 100 ksi | | 1300° F. (704° C.)/ 90 ksi | |
| Heat | Fe (wt %) | Co (wt %) | Heat Treatment Condition | UTS (ksi) | YS (ksi) | El (%) | RA (%) | UTS (ksi) | YS (ksi) | El (%) | RA (%) | Life (hrs) | El (%) | Life (hrs) | El (%) |
| 5 | 13.96 | 2.97 | As-HT | 214.8 | 159.8 | 25.4 | 46.9 | 189.6 | 137.8 | 21.3 | 27.1 | 72.8 | 32.0 | 26.8 | 40.0 |
| 6 | 9.99 | 2.96 | As-HT | 215.1 | 157.7 | 25.4 | 47.1 | 185.0 | 141.3 | 25.6 | 36.1 | 130.5 | 30.5 | 46.1 | 42.0 |
| GROUP 3: 5 wt % Co | | | | | | | | | | | | | | | |
| 7 | 18.08 | 5.01 | As-HT | 214.8 | 164.0 | 23.3 | 41.7 | 186.2 | 145.4 | 17.2 | 22.7 | 25.0 | 33.0 | 14.2 | 39.0 |
| | | | HT | 210.3 | 161.2 | 8.7 | 7.9 | 170.4 | 132.5 | 32.9 | 51.4 | 7.2 | 47.7 | 4.6 | 51.5 |
| | | | +1300° F./ (704° C.)/ 1000 h | R = 0.98 | R = 0.98 | | | R = 0.92 | R = 0.91 | | | R = 0.29 | | R = 0.32 | |
| 8 | 14.18 | 4.98 | As-HT | 219.8 | 164.1 | 21.6 | 38.6 | 186.3 | 145.6 | 22.9 | 35.5 | 97.6 | 29.6 | 32.1 | 25.0 |
| | | | HT | — | — | — | — | — | — | — | — | — | — | — | — |
| | | | +1300° F. (704° C.)/ 1000 h | — | — | | | — | — | | | — | | — | |
| 9 | 10.02 | 4.97 | As-HT | 209.2 | 152.8 | 27.9 | 53.5 | 182.1 | 132.3 | 21.6 | 21.0 | 235.3 | 30.7 | 80.7 | 33.3 |
| | | | HT | 201.7 | 147.9 | 25.5 | 49.7 | 174.9 | 127.5 | 26.2 | 31.4 | 45.4 | 32.0 | 36.7 | 41.3 |
| | | | +1300° F. (704° C.)/ 1000 h | R = 0.96 | R = 0.97 | | | R = 0.96 | R = 0.96 | | | R = 0.19 | | R = 0.45 | |
| 10 | 0.30 | 5.02 | As-HT | 206.5 | 158.4 | 30.0 | 53.2 | 173.5 | 136.7 | 14.0 | 18.2 | 0.0 | NB* | 0.1 | NB* |
| | | | HT | 204.5 | 146.6 | 27.2 | 45.2 | 173.2 | 124.9 | 10.5 | 12.1 | 24.2 | 7.3 | 12.2 | 12.0 |
| | | | +1300° F. (704° C.)/ 1000 h | R = 0.99 | R = 0.93 | | | R = 0.99 | R = 0.91 | | | — | | — | |
| GROUP 4: 9 wt % Co | | | | | | | | | | | | | | | |
| 11 | 18.03 | 8.93 | As-HT | 224.4 | 172.7 | 19.4 | 33.5 | 188.7 | 147.9 | 14.0 | 15.4 | 72.4 | 32.0 | 30.3 | 35.0 |
| | | | HT | 172.9 | 105.9 | 8.0 | 6.7 | 139.0 | 89.8 | 40.0 | 70.7 | 2.0 | 44.1 | 0.8 | 49.3 |
| | | | +1300° F. (704° C.)/ 1000 h | R = 0.77 | R = 0.61 | | | R = 0.74 | R = 0.61 | | | R = 0.03 | | R = 0.03 | |
| 12 | 10.1 | 9.24 | As-HT | 216.1 | 160.4 | 26.4 | 47.5 | 189.9 | 139.7 | 22.6 | 27.3 | 338.0 | 31.0 | 180.0 | 34.0 |
| | | | HT | 210.2 | 156.2 | 24.6 | 43.4 | 184.4 | 137.3 | 30.3 | 35.5 | 134.5 | 36.0 | 73.2 | 40.0 |
| | | | +1300° F. (704° C.)/ 1000 h | R = 97 | R = 97 | | | R = 0.97 | R = 98 | | | R = 0.4 | | R = 0.41 | |
| 13 | 0.30 | 8.95 | As-HT | 219.3 | 171.0 | 25.0 | 45.1 | 196.2 | 151.4 | 14.8 | 15.6 | 131.5 | 31.5 | 46.8 | 40.0 |
| | | | HT | 213.0 | 155.3 | 22.5 | 35.0 | 176.6 | 132.1 | 18.5 | 19.2 | 25.6 | 34.4 | 15.4 | 32.9 |
| | | | +1300° F. (704° C.)/ 1000 h | R = 0.97 | R = 0.91 | | | R = 0.90 | R = 0.87 | | | R = 0.20 | | R = 0.33 | |

*NB refers to Notch Break

Figure 9:
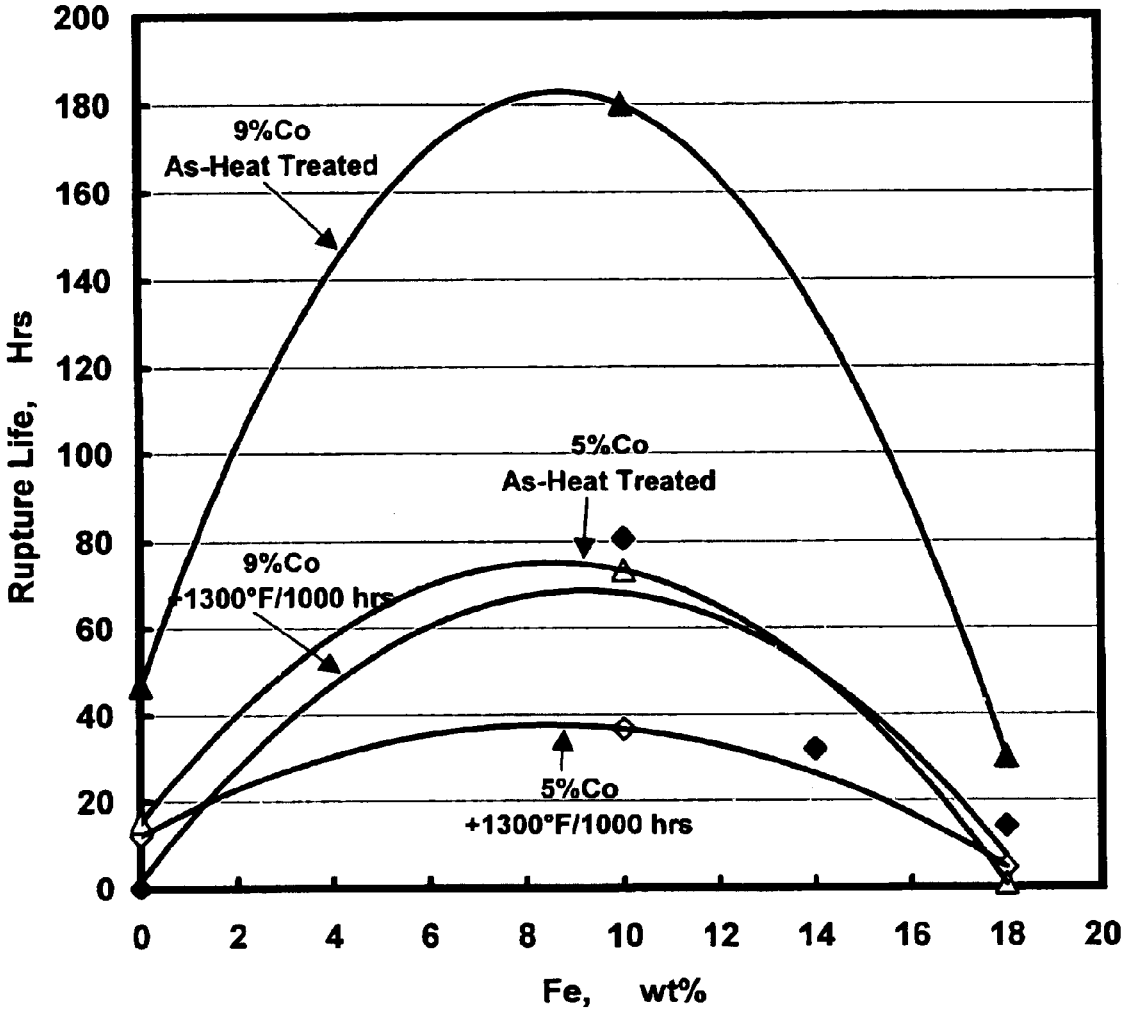
FIG. 9 is a plot of stress rupture life at 1300° F. (704° C.) and 90 ksi versus iron content for certain nickel-base alloys including about 1.45 weight percent aluminum and about 0.65 weight percent titanium.
Figure 10:
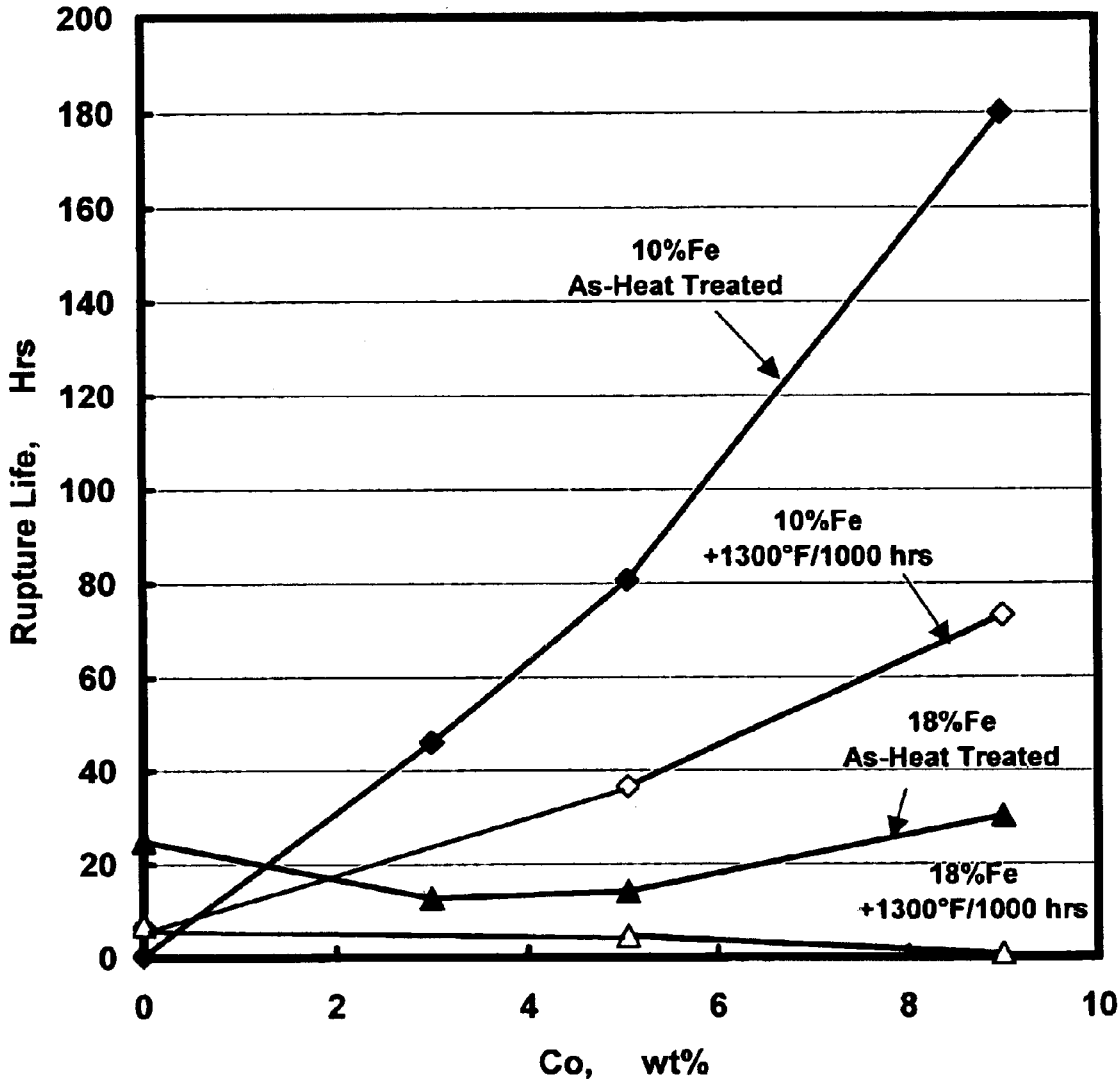
FIG. 10 is a plot of stress rupture life at 1300° F. (704° C.) and 90 ksi versus cobalt content for certain nickel-base alloys.

The data reported in Table 8 is plotted in FIGS. 9 and 10 and illustrates the effects of varying iron and cobalt contents in the test alloys. Referring specifically to Table 8, there appeared to be no consistent, significant effect on yield strength of the test alloys as iron and cobalt content was varied. From FIG. 9, however, iron and cobalt content appeared to have a significant effect on stress rupture life. For example, as shown in FIG. 9, when the iron content was at about 18 weight percent, approximately the nominal level for Alloy 718, there was relatively little improvement in stress rupture life when cobalt content was increased from 0 to about 9 weight percent. When, however, the iron content was reduced to about 14 percent, and particularly to about 10 percent, a more significant improvement in stress rupture life was observed when cobalt contents were within the range of the present invention. From Table 8, it is also apparent that the thermal stability, in terms of retention rate, R, tended to be the highest for those compositions with a combination of iron and cobalt within the ranges of the present invention. In particular, the present invention is directed to a nickel-base alloy that includes up to about 14 weight percent iron (alternatively about 6 up to about 12 percent or about 9 to about 11 percent), and about 5 up to about 12 weight percent (alternatively about 5 to about 10 percent or about 8.75 to about 9.25 percent) cobalt. It is believed that increasing the cobalt content significantly beyond the range of the present invention would not significantly improve the mechanical properties of the alloy, while negatively impacting processing characteristics and cost.

The effect of tungsten and molybdenum was investigated using the alloy compositions listed in Table 9. The alloys of Table 9 were made with the aluminum and titanium content adjusted to about 1.45 weight percent aluminum and 0.65 weight percent titanium, as discussed earlier. The iron content was maintained near a desired level of about 10 weight percent and the cobalt content was maintained near a desired level of about 9 weight percent.

TABLE 9

CHEMICAL COMPOSITION OF TEST ALLOYS TO STUDY TUNGSTEN AND MOLYBDENUM EFFECTS

| | Chemical Composition (wt %) | | | | | | | | | | |
|---|---|---|---|---|---|---|---|---|---|---|---|
| Heat | C | Mo | W | Cr | Co | Fe | Nb | Ti | Al | P | B |
| 1 | 0.023 | 0.05 | 0.02 | 17.6 | 8.77 | 10.1 | 5.39 | 0.64 | 1.43 | 0.005 | 0.003 |
| 2 | 0.022 | 2.90 | <0.01 | 18.0 | 8.95 | 10.0 | 5.40 | 0.65 | 1.45 | 0.007 | 0.004 |
| 3 | 0.028 | 0.03 | 4.00 | 17.3 | 8.87 | 10.4 | 5.31 | 0.63 | 1.43 | 0.007 | 0.003 |
| 4 | 0.027 | 0.03 | 5.73 | 16.9 | 8.71 | 10.1 | 5.17 | 0.62 | 1.39 | 0.008 | 0.003 |
| 5 | 0.031 | 2.88 | 1.02 | 17.3 | 8.85 | 9.92 | 5.49 | 0.64 | 1.45 | 0.007 | 0.004 |
| 6 | 0.023 | 2.84 | 2.28 | 16.5 | 8.95 | 9.44 | 5.03 | 0.60 | 1.33 | 0.005 | 0.003 |

The mechanical properties of the alloys listed in Table 9 are given in Table 10. The test samples listed in Tables 9 and 10 were processed, heat treated and tested in the same manner as discussed earlier with respect to Tables 1 and 2.

TABLE 10

EFFECT OF TUNGSTEN AND MOLYBDENUM LEVELS ON MECHANICAL PROPERTIES

| | | | | Tensile Properties | | | | | | | | Stress Rupture | |
|---|---|---|---|---|---|---|---|---|---|---|---|---|---|
| | | | | 68° F. (20° C.) | | | | 1300° F. (704° C.) | | | | 1300° F. (704° C.)/80 ksi | |
| Heat | W (wt %) | Mo (wt %) | Heat Treatment | UTS (ksi) | YS (ksi) | El (%) | RA (%) | UTS (ksi) | YS (ksi) | El (%) | RA (%) | Life (hrs) | El (%) |
| 1 | 0.02 | 0.05 | As-HT | 211.1 | 153.6 | 25.9 | 46.9 | 150.7 | 124.7 | 11.7 | 11.8 | 29.3* | 2.8* |
| | | | HT + 1400° F. | 193.1 | 133.3 | 26.7 | 42.9 | 139.8 | 114.4 | 21.9 | 22.5 | 63.8 | 14.6 |
| | | | (760° C.)/ 50 h | R = 0.91 | R = 0.87 | | | R = 0.93 | R = 0.92 | | | R > 1 | |
| 2 | <.01 | 2.90 | As-HT | 219.3 | 158.7 | 25.2 | 32.6 | 157.7 | 127.7 | 14.2 | 18.2 | 91.9 | 36.0 |
| | | | HT + 1400° F. | 208.3 | 148.5 | 26.7 | 34.6 | 146.8 | 123.9 | 32.9 | 51.0 | 71.2 | 44.7 |
| | | | (760° C.)/ 50 h | R = 0.95 | R = 0.94 | | | R = 0.93 | R = 0.97 | | | R = 0.78 | |
| 3 | 4.00 | 0.03 | As-HT | 217.0 | 153.0 | 26.1 | 40.7 | 156.9 | 123.0 | 15.0 | 14.5 | 0.4 | NB** |
| | | | HT + 1400° F. | 206.8 | 141.7 | 25.9 | 40.4 | 153.2 | 124.2 | 19.1 | 19.7 | 127.7 | 33.0 |
| | | | (760° C.)/ 50 h | R = 0.95 | R = 0.93 | | | R = 0.98 | R > 1 | | | — | |
| 4 | 5.73 | 0.03 | As-HT | 212.7 | 148.9 | 27.0 | 40.9 | 154.7 | 121.4 | 13.1 | 15.9 | 141.2* | 7.5* |
| | | | HT + 1400° F. | 208.2 | 143.2 | 28.0 | 41.8 | 161.4 | 122.7 | 16.5 | 15.3 | 209.9 | 31.9 |
| | | | (760° C.)/ 50 h | R = 0.98 | R = 0.96 | | | R > 1 | R > 1 | | | R > 1 | |
| 5 | 1.02 | 2.88 | As-HT | 210.1 | 147.5 | 26.8 | 40.9 | 151.6 | 119.0 | 13.7 | 14.7 | 115.0 | 36.0 |
| | | | HT + 1400° F. | 204.9 | 140.0 | 26.8 | 35.2 | 151.7 | 121.7 | 21.8 | 23.1 | 176.3 | 50.8 |
| | | | (760° C.)/ 50 h | R = 0.96 | R = 0.92 | | | R = 1 | R > 1 | | | R > 1 | |
| 6 | 2.28 | 2.84 | As-HT | 208.1 | 150.4 | 30.1 | 52.7 | 145.2 | 118.5 | 11.3 | 13.8 | 138.3* | 7.1* |
| | | | HT + 1400° F. | 197.6 | 136.4 | 33.0 | 53.5 | 153.0 | 119.7 | 13.2 | 12.3 | 180.1 | 25.2 |
| | | | (760° C.)/ 50 h | R = 0.95 | R = 0.91 | | | R > 1 | R > 1 | | | R > 1 | |

*One sample broke at notch and was not included in the calculation.
**NB refers to Notch Break As is seen from Table 10, the test alloy without tungsten and molybdenum additions appeared to exhibit reduced stress rupture life, reduced rupture ductility and one occurrence of a notch break. As is also seen, the addition of molybdenum or tungsten, either alone or in combination, appeared to improve the stress rupture life and thermal stability of the test alloys in Table 10. Thermal stability, as measured by retention ratio R, for stress rupture life was generally higher for those alloys with molybdenum and/or tungsten. The present invention is directed to a nickel-base alloy that includes up to about 4 weight percent molybdenum (alternatively about 2 up to about 4 percent or about 2.75 to about 3.25 percent), and up to about 6 weight percent (alternatively about 1 to about 2 percent or about 0.75 to about 1.25 percent) tungsten, wherein the sum of molybdenum and tungsten is at least about 2 percent and not more than about 8 percent (alternatively about 3 percent to about 8 percent or about 3 percent to about 4.5 percent).

The effect of niobium content was investigated using the alloy compositions listed in Table 11. The alloys of Table 11 were prepared with the iron, cobalt and tungsten additions at preferable levels within the present invention. Aluminum and titanium levels were varied to avoid potential problems associated with higher niobium content, such as inferior hot workability and weldability. The chromium was adjusted to prevent unfavorable microstructure and freckle formation during solidification.

TABLE 11

CHEMICAL COMPOSITION OF TEST ALLOYS TO STUDY NIOBIUM EFFECTS

| | Chemical Composition (wt %) | | | | | | | | | | |
|---|---|---|---|---|---|---|---|---|---|---|---|
| Heat | C | Mo | W | Cr | Co | Fe | Nb | Ti | Al | P | B |
| 1 | 0.032 | 2.89 | 0.89 | 17.9 | 9.16 | 9.93 | 5.40 | 0.46 | 0.90 | 0.008 | 0.005 |
| 2 | 0.032 | 2.87 | 1.00 | 13.9 | 9.14 | 9.91 | 6.13 | 0.46 | 0.92 | 0.008 | 0.004 |
| 3 | 0.028 | 2.89 | 1.01 | 17.9 | 9.12 | 9.98 | 5.38 | 0.56 | 1.20 | 0.009 | 0.005 |
| 4 | 0.028 | 2.88 | 1.00 | 13.9 | 8.94 | 9.91 | 6.16 | 0.54 | 1.17 | 0.006 | 0.004 |
| 5 | 0.031 | 2.88 | 1.02 | 17.4 | 8.90 | 9.92 | 5.47 | 0.64 | 1.45 | 0.005 | 0.004 |

The mechanical properties of the alloys listed in Table 11 are given in Table 12. The test samples listed in Tables 11 and 12 were processed, heat treated and tested in the same manner as discussed earlier with respect to Tables 1 and 2.

TABLE 12

EFFECT OF NIOBIUM LEVEL ON MECHANICAL PROPERTIES

| | | | | | Tensile Properties | | | | | | | | Stress Rupture 1300° F. | |
|---|---|---|---|---|---|---|---|---|---|---|---|---|---|---|
| | | | | | 68° F. (20° C.) | | | | 1300° F. (704° C.) | | | | (704° C.)/80 ksi | |
| Heat | Al (wt %) | Ti (wt %) | Nb (wt %) | Heat Treatment | UTS (ksi) | YS (ksi) | El (%) | RA (%) | UTS (ksi) | YS (ksi) | El (%) | RA (%) | Life (hrs) | El (%) |
| 1 | 0.90 | 0.46 | 5.40 | As-HT | 191.3 | 130.7 | 36.8 | 53.4 | 133.7 | 100.3 | 19.1 | 18.2 | 114.0 | 17.9 |
| | | | | HT + 1400° F. | 179.5 | 114.4 | 34.2 | 53.6 | 135.2 | 101.0 | 29.2 | 28.8 | 123.7 | 40.8 |
| | | | | (760° C.)/50 h | R = 0.94 | R = 0.88 | | | R > 1 | R > 1 | | | R > 1 | |
| 2 | 0.92 | 0.46 | 6.13 | As-HT | 207.8 | 154.5 | 29.6 | 48.8 | 139.7 | 118.5 | 11.9 | 15.5 | 99.6 | 23.1 |
| | | | | HT + 1400° F. | 194.1 | 136.8 | 29.6 | 46.2 | 146.4 | 121.2 | 18.1 | 19.4 | 111.4 | 37.6 |
| | | | | (760° C.)/50 h | R = 0.93 | R = 0.88 | | | R > 1 | R > 1 | | | R > 1 | |
| 3 | 1.20 | 0.57 | 5.38 | As-HT | 203.6 | 144.8 | 32.5 | 53.3 | 140.4 | 111.6 | 14.0 | 15.0 | 141.4 | 42.3 |
| | | | | HT + 1400° F. | 189.7 | 126.9 | 32.2 | 50.8 | 148.0 | 115.1 | 21.4 | 25.8 | 177.4 | 26.6 |
| | | | | (760° C.)/50 h | R = 0.93 | R = 0.88 | | | R > 1 | R > 1 | | | R > 1 | |
| 4 | 1.17 | 0.54 | 6.16 | As-HT | 207.4 | 149.7 | 30.6 | 50.0 | 140.0 | 117.9 | 11.2 | 9.6 | 132.9 | 8.8 |
| | | | | HT + 1400° F. | 198.2 | 138.2 | 29.2 | 46.4 | 154.7 | 124.9 | 12.4 | 14.5 | 161.4 | 19.5 |
| | | | | (760° C.)/50 h | R = 0.96 | R = 0.92 | | | R > 1 | R > 1 | | | R > 1 | |
| 5 | 1.45 | 0.64 | 5.47 | As-HT | 210.1 | 147.5 | 26.8 | 40.9 | 151.6 | 119.0 | 13.7 | 14.7 | 115.0 | 36.0 |
| | | | | HT + 1400° F. | 204.9 | 140.0 | 26.8 | 35.2 | 151.7 | 121.7 | 21.8 | 23.1 | 176.3 | 50.8 |
| | | | | (760° C.)/50 h | R = 0.98 | R = 0.95 | | | R > 1 | R > 1 | | | R > 1 | |

As is seen from Table 12, increased levels of niobium did appear to improve the strength of the test alloys, although there was no apparent improvement in stress rupture properties. The thermal stability of the test alloys did not appear to change with increased niobium content. One aspect of the present invention is directed to a nickel-base alloy that includes about 4 up to about 8 weight percent niobium (alternatively about 5 up to about 7 percent or about 5 to about 5.5 percent), and wherein the atomic percent of aluminum plus titanium divided by the atomic percent of niobium is from about 0.8 to about 1.3 (alternatively about 0.9 to about 1.2 or about 1.0 to about 1.2).

Hot workability properties of embodiments of the alloys of the present invention were evaluated by rapid strain rate tensile tests. This is a conventional hot tensile test per ASTM E21 except that it is performed at higher strain rates (about $10^{-1}$ sec). Percent reduction in area is measured at a variety of temperatures and gives an indication of the allowable hot working temperature range and the degree of cracking which might be encountered.

Figure 11:
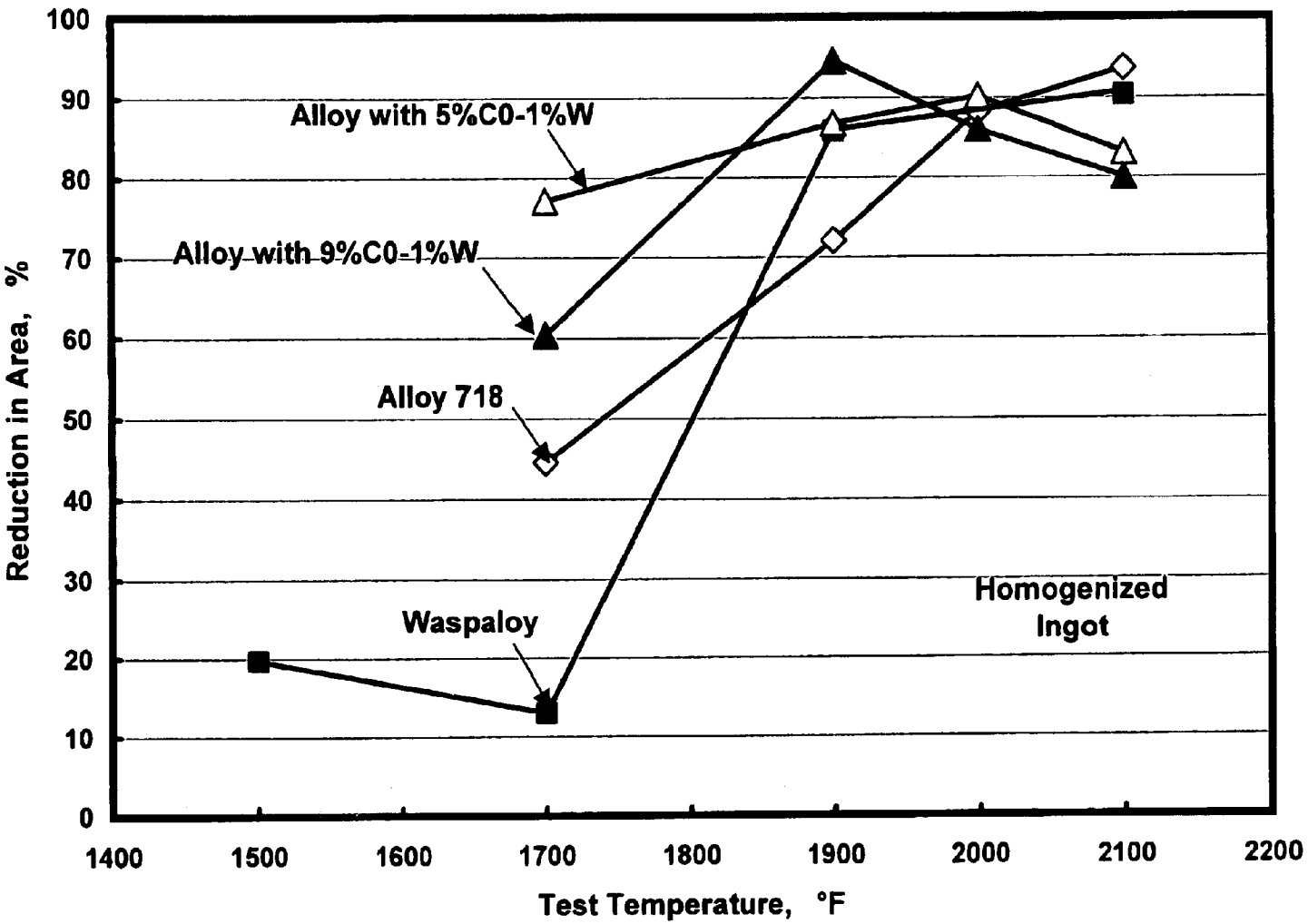
FIG. 11 is a plot of percentage reduction in area in a rapid strain rate tensile test as a function of test temperature for various nickel-base alloys.

The results presented in FIG. 11 show that alloys within the present invention appear to have relatively high reduction in area value (at least about 60%) over the entire range of temperatures normally employed for hot working 718-type superalloys (1700° F.–2050° F.) (927° C.–1121° C.). Reduction in area values at the low end of the hot working range, about 1700° F. (927° C.), where cold cracking may typically be experienced, appeared to significantly exceed the value for Alloy 718 and even farther exceeded the values for Waspaloy. Over the rest of the temperature range, the alloys of the present invention exhibited reduction in area values at least equal to Alloy 718 and Waspaloy. The only exception was that at the highest test temperature (2100° F.) (1149° C.), the reduction in area value for Alloy 718 and Waspaloy slightly exceeded that of the test alloys. However, the reduction in area values for the test alloys were still about 80% and, therefore, very acceptable.

Figure 12:
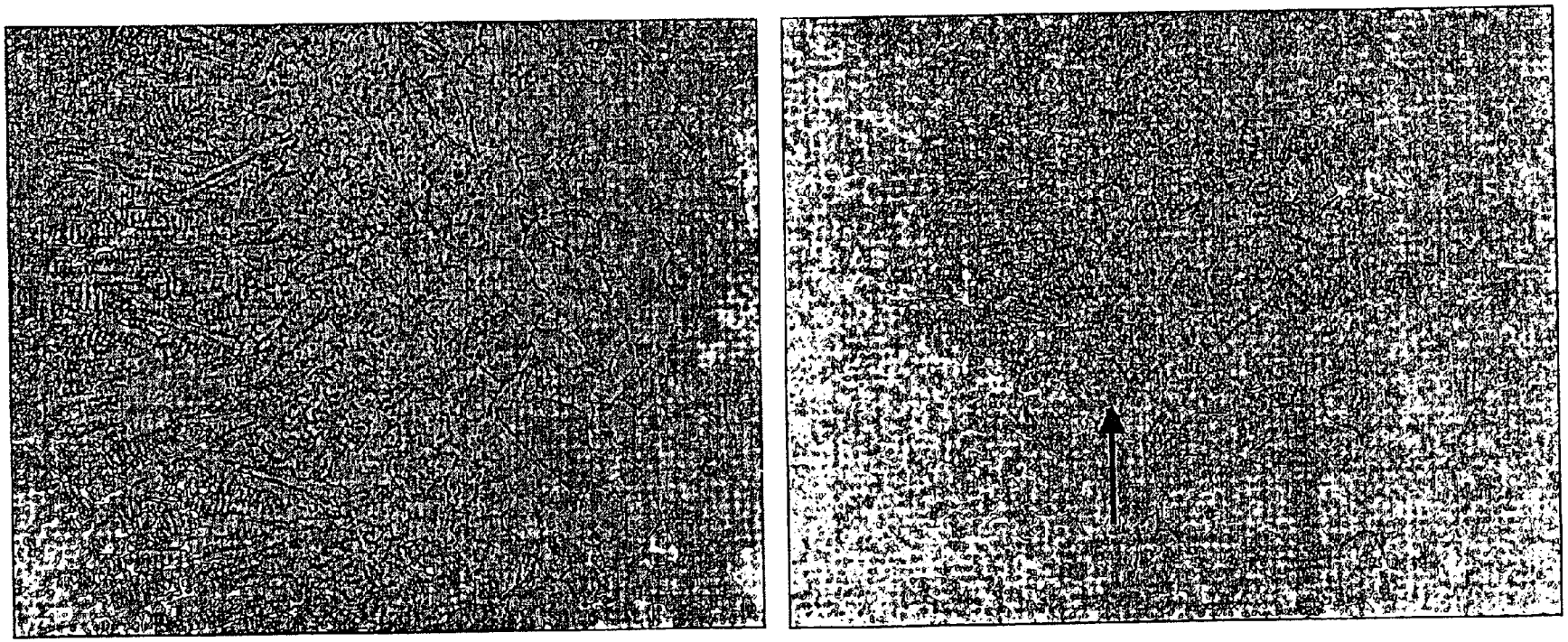
FIG. 12 is a pair of photomicrographs of a longitudinal section of a TIG weld bead for (a) an embodiment of the present invention, and (b) Waspaloy.

The weldability of the test alloys, 718, and Waspaloy alloys was evaluated by performing fillerless TIG (tungsten inert gas) welding on samples under identical conditions. The welds were subsequently sectioned and metallographically examined. No cracks were found in the samples of 718 or the test alloys, but cracks were found in the Waspaloy alloy, as is shown in FIG. 12. These tests suggest that alloys of the present invention have weldability generally comparable to that of Alloy 718, but superior to the Waspaloy alloy.

The inventor made an additional series of heats with the compositions shown in Table 13.

TABLE 13

CHEMICAL COMPOSITION OF SELECTED TEST ALLOYS

| | Chemical Composition (wt %) | | | | | | | | | | | | |
|---|---|---|---|---|---|---|---|---|---|---|---|---|---|
| Heat | C | Mo | W | Cr | Co | Fe | Nb | Ti | Al | S | N | P | B |
| 1 | 0.028 | 2.90 | 1.00 | 17.39 | 5.96 | 9.98 | 5.38 | 0.64 | 1.41 | 0.0004 | 0.0024 | 0.0160 | 0.0070 |
| 2 | 0.033 | 2.92 | 0.94 | 17.60 | 9.23 | 10.07 | 5.30 | 0.65 | 1.51 | 0.0004 | 0.0029 | 0.0147 | 0.0080 |
| Alloy 718 | 0.023 | 2.90 | <0.01 | 18.10 | 0.02 | 17.20 | 5.37 | 0.94 | 0.49 | 0.0005 | 0.0058 | 0.0050 | 0.0041 |
| Waspaloy | 0.036 | 4.26 | <0.01 | 19.73 | 13.38 | 0.06 | <0.01 | 3.04 | 1.27 | 0.0006 | 0.0044 | 0.0060 | 0.0060 |

The mechanical properties of the alloys listed in Table 13 are given in Table 14. These selected alloys were made and tested in the same manner as described earlier with respect to the previously disclosed test alloys, except that the Waspaloy sample was heat treated according to the usual commercial practice (i.e., solution treatment at 1865° F. (1018° C.) for 4 hours, water quenched, aged at 1550° F. (843° C.) for 4 hours, air cooled, aged at 1400° F. (760°) for 16 hours and then air cooled to room temperature).

From the data in Table 14, it is apparent that the tensile strength of the alloys within the present invention was very close to that of Waspaloy. Thermal stability (R) was also very similar to that of Waspaloy and superior to that of Alloy 718. Stress rupture and creep life at all measured conditions was superior for the present invention as compared to both Alloy 718 and Waspaloy. In addition, the thermal stability of the test alloys for the time dependent stress rupture and creep properties was comparable to that of Waspaloy. Thus, it is seen from the preceding description that embodiments of the nickel-base alloy of the present invention appear to be

TABLE 14

MECHANICAL PROPERTIES OF SELECTED ALLOYS

| | | Tensile Properties | | | | | | | |
|---|---|---|---|---|---|---|---|---|---|
| | | 68° F. (20° C.) | | | | 1300° F. (704° C.) | | | |
| Heat | Heat Treatment | UTS (ksi) | YS (ksi) | El (%) | RA (%) | UTS (ksi) | YS (ksi) | El (%) | RA (%) |
| 1 | As-HT | 217.0 | 158.3 | 24.6 | 41.5 | 161.4 | 122.5 | 17.1 | 22.2 |
| | HT + 1300° F. (704° C.)/ 1000 h | 206.2 R = 0.95 | 144.1 R = 0.91 | 24.2 | 40.0 | 148.9 R = 0.92 | 115.9 R = 0.95 | 27.2 | 47.2 |
| 2 | As-HT | 208.0 | 150.4 | 27.5 | 45.6 | 168.0 | 121.5 | 23.8 | 35.2 |
| | HT + 1300° F. (704° C.)/ 1000 h | 211.7 R > 1 | 151.3 R > 1 | 24.5 | 35.0 | 164.5 R = 0.98 | 129.1 R > 1 | 24.8 | 38.0 |
| Alloy 718 | As-HT | 211.6 | 174.3 | 20.2 | 40.6 | 144.5 | 128.6 | 17.3 | 21.2 |
| | HT + 1300° F. (704° C.)/ 1000 h | 193.3 R = 0.91 | 142.6 R = 0.82 | 20.9 | 27.6 | 122.3 R = 0.85 | 101.8 R = 0.79 | 38.3 | 66.9 |
| Waspaloy | As-HT | 209.0 | 157.6 | 27.0 | 45.4 | 157.4 | 135.3 | 40.1 | 67.1 |
| | HT + 1300° F. (704° C.)/ 1000 h | | | | | 147.2 R = 0.94 | 126.6 R = 0.94 | 38.9 | 48.0 |

| | Stress Rupture | | | | Creep | |
|---|---|---|---|---|---|---|
| | 1250° F. (677° C.)/100 ksi | | 1300° F. (704° C.)/80 ksi | | 1300° F. (704° C.)/70 ksi | |
| Heat | Life (hrs) | El (%) | Life (hrs) | El (%) | $t_{0.2}$ hrs. | $t_{0.5}$ hrs. |
| 1 | 298 | 36.5 | 244.7 | 27.7 | 103.5 | 232 |
| | | | 185 | 28.6 | 39.1 | 124.8 |
| | | | R = 0.77 | | R = 0.38 | R = 0.54 |
| 2 | 309 | 40.0 | 346 | 39.5 | 191.7 | 342.4 |
| | 340 | 31.0 | 336 | 40.8 | 67.4 | 228.6 |
| | R >1 | | R = 0.97 | | R = 0.35 | R = 0.67 |
| Alloy 718 | 30.5 | 41.6 | 64.5 | 25.5 | 21.4 | 59.9 |
| | 2.3 | 39.3 | 15.1 | 34.3 | 0.3 | 1.4 |
| | R = 0.08 | | R = 0.23 | | R = 0.01 | R = 0.02 |
| Waspaloy | | | 74.2 | 37.5 | 25.0 | 49.0 |
| | | | 65.6 | 38.0 | 8.5 | 26.7 |
| | | | R = 0.88 | | R = 0.34 | R = 0.54 |

capable of a combination of high tensile strength, stress rupture and creep life, and long time thermal stability as compared to certain commercial alloys, such as Alloy 718 and Waspaloy, while maintaining good hot workability, weldability and favorable cost as compared to those alloys.

It is to be understood that the present description illustrates aspects of the invention relevant to a clear understanding of the invention. Certain aspects of the invention would be apparent to those of ordinary skill in the art and that, therefore, would not facilitate a better understanding of the invention have not been presented in order to simplify the present description. Although the present invention has been described in connection with only certain embodiments, those of ordinary skill in the art will, upon considering the foregoing description, recognize that many embodiments, modifications, and variations of the invention may be made. The foregoing description and the following claims covers all such variations and modifications of the invention.

What is claimed is:

1. A nickel-base alloy comprising, in weight percent: up to about 0.10 percent carbon; about 12 up to about 20 percent chromium; up to about 4 percent molybdenum; up to about 6 percent tungsten, wherein the sum of molybdenum and tungsten is at least about 2 percent and not more than about 8 percent; about 5 up to about 12 percent cobalt; up to about 14 percent iron; about 4 percent up to about 8 percent niobium; about 0.6 percent up to about 2.6 percent aluminum; about 0.4 percent up to about 1.4 percent titanium; about 0.003 percent up to about 0.03 percent phosphorous; about 0.003 percent up to about 0.015 percent boron; nickel; and incidental impurities, and wherein the sum of atomic percent aluminum and atomic percent titanium is from about 2 to about 6 percent, the ratio of atomic percent aluminum to atomic percent titanium is at least about 1.5, and the atomic percent of aluminum plus titanium divided by the atomic percent of niobium equals about 0.8 to about 1.3.

2. The nickel-base alloy of claim 1 wherein the sum of atomic percent aluminum and atomic percent titanium is from about 2.5 to about 5 percent.

3. The nickel-base alloy of claim 2 wherein the sum of atomic percent aluminum and atomic percent titanium is from about 3 to about 4 percent.

4. The nickel-base alloy of claim 1 wherein the ratio of atomic percent aluminum to atomic percent titanium from about 2 to about 4.

5. The nickel-base alloy of claim 4 wherein the ratio of atomic percent aluminum to atomic percent titanium is from about 3 to about 4.

6. The nickel-base alloy of claim 1 wherein the atomic percent of aluminum plus titanium divided by the atomic percent of niobium equals about 0.9 to about 1.2.

7. The nickel-base alloy of claim 6 wherein the atomic percent of aluminum plus titanium divided by the atomic percent of niobium equals about 1.0 to about 1.2.

8. The nickel-base alloy of claim 1 comprising about 2 to about 4 percent molybdenum.

9. The nickel-base alloy of claim 8 comprising about 2.75 to about 3.25 percent molybdenum.

10. The nickel-base alloy of claim 1 comprising about 1 up to about 2 percent tungsten.

11. The nickel-base alloy of claim 1 comprising about 0.75 up to about 1.25 percent tungsten.

12. The nickel-base alloy of claim 1 wherein the sum of molybdenum and tungsten is from about 3 percent to about 8 percent.

13. The nickel-base alloy of claim 12 wherein the sum of molybdenum and tungsten is from about 3 to about 4.5 percent.

14. The nickel-base alloy of claim 1 comprising about 5 up to about 10 percent cobalt.

15. The nickel-base alloy of claim 14 comprising about 8.75 up to about 9.25 percent cobalt.

16. The nickel-base alloy of claim 1 comprising about 6 up to about 12 percent iron.

17. The nickel-base alloy of claim 16 comprising about 9 up to about 11 percent iron.

18. The nickel-base alloy of claim 1 comprising about 0.9 up to about 2.0 percent aluminum.

19. The nickel-base alloy of claim 18 comprising about 1.2 up to about 1.5 percent aluminum.

20. The nickel-base alloy of claim 1 comprising about 0.45 up to about 1.4 percent titanium.

21. The nickel-base alloy of claim 20 comprising about 0.55 up to about 0.7 percent titanium.

22. The nickel-base alloy of claim 1 comprising about 5 up to about 7 percent niobium.

23. The nickel-base alloy of claim 22 comprising about 5 up to about 5.5 percent niobium.

24. The nickel-base alloy of claim 1 comprising about 0.005 up to about 0.025 percent phosphorous.

25. The nickel-base alloy of claim 24 comprising about 0.01 up to about 0.02 percent phosphorous.

26. The nickel-base alloy of claim 1 comprising about 0.004 to about 0.011 percent boron.

27. The nickel-base alloy of claim 26 comprising about 0.006 to about 0.009 percent boron.

28. A nickel-base alloy comprising, in weight percent: up to about 0.10 percent carbon; about 12 up to about 20 percent chromium; about 2 to about 4 percent molybdenum; about 1 up to about 2 percent tungsten; about 5 up to about 10 percent cobalt; about 6 up to about 12 percent iron; about 5 percent up to about 7 percent niobium; about 0.9 percent up to about 2.0 percent aluminum; about 0.45 percent up to about 1.4 percent titanium; about 0.005 percent up to about 0.025 percent phosphorous; about 0.004 to about 0.011 percent boron; nickel; and incidental impurities, and wherein the sum of atomic percent aluminum and atomic percent titanium is from about 2 to about 6 percent, the ratio of atomic percent aluminum to atomic percent titanium is at least about 1.5, and the atomic percent of aluminum plus titanium divided by the atomic percent of niobium equals about 0.8 to about 1.3.

29. The nickel-base alloy of claim 1 wherein the sum of atomic percent aluminum and atomic percent titanium is from about 2.5 to about 5 percent.

30. The nickel-base alloy of claim 29 wherein the sum of atomic percent aluminum and atomic percent titanium is from about 3 to about 4 percent.

31. The nickel-base alloy of claim 28 wherein the ratio of atomic percent aluminum to atomic percent titanium from about 2 to about 4.

32. The nickel-base alloy of claim 31 wherein the ratio of atomic percent aluminum to atomic percent titanium is from about 3 to about 4.

33. The nickel-base alloy of claim 28 wherein the atomic percent of aluminum plus titanium divided by the atomic percent of niobium equals about 0.9 to about 1.2.

34. The nickel-base alloy of claim 33 wherein the atomic percent of aluminum plus titanium divided by the atomic percent of niobium equals about 1.0 to about 1.2.

35. An article of manufacture including a nickel-base alloy, the nickel-base alloy comprising, in weight percent: up to about 0.10 percent carbon; about 12 up to about 20 percent chromium; up to about 4 percent molybdenum; up to about 6 percent tungsten, wherein the sum of molybdenum and tungsten is at least about 2 percent and not more than about 8 percent; about 5 up to about 12 percent cobalt; up to about 14 percent iron; about 4 percent up to about 8 percent niobium; about 0.6 percent up to about 2.6 percent aluminum; about 0.4 percent up to about 1.4 percent titanium; about 0.003 percent up to about 0.03 percent phosphorous; about 0.003 percent up to about 0.015 percent boron; nickel; and incidental impurities, and wherein the sum of atomic percent aluminum and atomic percent titanium is from about 2 to about 6 percent, the ratio of atomic percent aluminum to atomic percent titanium is at least about 1.5, and the atomic percent of aluminum plus titanium divided by the atomic percent of niobium equals about 0.8 to about 1.3.

36. The article of manufacture of claim 35 wherein the article of manufacture is selected from a disk, a blade, a fastener, a case, and a shaft.

37. The article of manufacture of claim 35 wherein the article is a component of a gas turbine engine.

38. A nickel-base alloy comprising, in weight percent, up to about 0.10 percent carbon; about 12 up to about 20 percent chromium; up to about 4 percent molybdenum; up to about 6 percent tungsten, wherein the sum of molybdenum and tungsten is at least about 2 percent and not more than about 8 percent; about 5 up to about 12 percent cobalt; up to about 14 percent iron; about 4 percent up to about 8 percent niobium; about 0.6 percent up to about 2.6 percent aluminum; about 0.4 percent up to about 1.4 percent titanium; about 0.003 percent up to about 0.03 percent phosphorous; about 0.003 percent up to about 0.015 percent boron; nickel; and incidental impurities, wherein the sum of atomic percent aluminum and atomic percent titanium is from about 2 to about 6 percent, the ratio of atomic percent aluminum to atomic percent titanium is at least about 1.5, the atomic percent of aluminum plus titanium divided by the atomic percent of niobium equals about 0.8 to about 1.3, and wherein said alloy has a reduction in area value of at least about 60% over the entire range of temperatures from 1700° F. to 2050° F.

* * * * *

UNITED STATES PATENT AND TRADEMARK OFFICE

CERTIFICATE OF CORRECTION

PATENT NO. : 6,730,264 B2
DATED : May 4, 2004
INVENTOR(S) : Wei-Di Cao

It is certified that error appears in the above-identified patent and that said Letters Patent is hereby corrected as shown below:

Column 3,
Line 25, "weld ability" should read -- weldability,"

Columns 11 and 12,
Table 4, in the column titled "Life (hrs)", "62.8" should read -- 62.6 --

Columns 13 and 14,
Table 4 cont, in the column titled "Heat Treatment Condition" "1000 h" should be added at the end of the entry for Heat 8

Column 14,
Line 46, "n" should read -- iron --

Column 18,
Table 7, in the title of this table, delete "WITH"

Columns 19 and 20,
In the row containing the 12th Heat in the 10th column, "R = 98" should read -- R=0.98 --

Signed and Sealed this

First Day of February, 2005

JON W. DUDAS
*Director of the United States Patent and Trademark Office*